US010295943B2

(12) United States Patent
Sakakibara et al.

(10) Patent No.: US 10,295,943 B2
(45) Date of Patent: May 21, 2019

(54) IMAGE FORMING APPARATUS AND IMAGE FORMING METHOD

(71) Applicant: SHARP KABUSHIKI KAISHA, Sakai, Osaka (JP)

(72) Inventors: Yusuke Sakakibara, Sakai (JP); Kyohko Matsuda, Sakai (JP); Makoto Izumi, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 15/904,706

(22) Filed: Feb. 26, 2018

(65) Prior Publication Data

US 2018/0253049 A1 Sep. 6, 2018

(30) Foreign Application Priority Data

Mar. 3, 2017 (JP) ..... 2017-040787

(51) Int. Cl.
*G03G 15/00* (2006.01)
*G03G 15/20* (2006.01)

(52) U.S. Cl.
CPC ..... *G03G 15/5029* (2013.01); *G03G 15/6511* (2013.01); *G03G 15/6558* (2013.01); *G03G 15/2039* (2013.01); *G03G 2215/0062* (2013.01)

(58) Field of Classification Search
CPC ..... G03G 15/5029; G03G 2215/00616; G03G 2215/0062; G03G 2215/00776
See application file for complete search history.

(56) References Cited

U.S. PATENT DOCUMENTS 9,250,591 B2 * 2/2016 Yagi ..... G03G 15/5029
2016/0152052 A1 6/2016 Namiki et al.

FOREIGN PATENT DOCUMENTS

| | | | | |
|---|---|---|---|---|
| JP | 05-107945 | A | | 4/1993 |
| JP | 07-196207 | A | | 8/1995 |
| JP | H10-340015 | A | | 12/1998 |
| JP | H11-237377 | A | | 8/1999 |
| JP | 2001139189 | A | * | 5/2001 |
| JP | 2002-023588 | A | | 1/2002 |
| JP | 2003-005479 | A | | 1/2003 |
| JP | 2006-052069 | A | | 2/2006 |
| JP | 2006-053398 | A | | 2/2006 |
| JP | 2010-058885 | A | | 3/2010 |
| JP | 2016-102867 | A | | 6/2016 |

(Continued)

OTHER PUBLICATIONS

Che (JP 2016-0152052 A1), Sep. 2016, JPO Computer Translation.*

*Primary Examiner* — Erika J Villaluna
(74) *Attorney, Agent, or Firm* — ScienBiziP, P.C.

(57) ABSTRACT

Type and moisture content of a sheet of paper are determined with high accuracy for controlling an image forming condition, accordingly. A coping machine includes a transmitted-light measuring unit, a reflected-light measuring unit, a type determination unit configured to determine a type of a sheet of paper, a moisture content calculation unit configured to calculate a moisture content of the sheet of paper, based on the type of the sheet of paper determined by the type determination unit and the intensity of the light measured by the reflected-light measuring unit, and an image forming condition setting unit configured to set an image forming condition for the sheet of paper.

18 Claims, 22 Drawing Sheets

(56) References Cited

FOREIGN PATENT DOCUMENTS

| | | | | |
|---|---|---|---|---|
| JP | 2016166948 | A | * | 9/2016 |
| WO | 2017/179248 | A1 | | 10/2017 |
| WO | 2018/029884 | A1 | | 2/2018 |

* cited by examiner

| INSPECTION NO. | PREDICTED VALUE | UNCERTAINTY |
|---|---|---|
| 1 | 0. 112 | 0. 289 |
| 2 | 1. 167 | 0. 112 |
| 3 | 0. 989 | 0. 045 |
| 4 | −0. 071 | 0. 210 |
| 5 | 0. 231 | 0. 545 |

FIG. 9

| PRINTING CONDITIONS | MOISTURE CONTENT | ENVIRONMENTAL CONDITION (TEMPERATURE) | PAPER TYPE | TRANSFER CONDITION | | FIXING CONDITION | | |
|---|---|---|---|---|---|---|---|---|
| | | | | TRANSFER CHARGER SUPPLIED VOLTAGE | TRANSFER CHARGER APPLIED CURRENT VALUE | PRESSING OF PRESSURE ROLLER | HEAT SOURCE DRIVE CURRENT | PAPER CONVEYANCE SPEED |
| HIGH RESOLUTION DARKLY SHRINK ... | 7% TO 8% | 10°C TO 15°C | PLAIN SHEET OF PAPER | +1.6 kV | LARGE | SMALL | SMALL | LARGE |
| ... | 8% TO 8.5% | 20°C TO 30°C | CARDBOARD | +1.2 kV | SMALL | LARGE | LARGE | SMALL |
| ... | ... | ... | ... | ... | ... | ... | ... | ... |
| ... | ... | ... | ... | ... | ... | ... | ... | ... |

FIG. 12

IMAGE FORMING APPARATUS AND IMAGE FORMING METHOD

BACKGROUND

Technical Field

The disclosure relates to an imaging forming apparatus for forming an image on a sheet of paper, and an image forming method for the image forming apparatus.

Related Art

In image forming apparatuses such as copying machines, printers, facsimile machines, and the multifunction peripherals, image formation (printing) is performed according to the following process. First, after toner is adhered to a photosensitive drum by static electricity, a potential difference is applied between the toner and the sheet of paper to transfer the toner onto the sheet of paper. Next, the toner is heated and pressed by a heating roller and a pressure roller to fix the toner onto the sheet of paper.

In a case where a sheet of paper having an unexpected thickness is used, however, the pressure applied by the pressure roller and the conveyance speed of the sheet of paper become unsuitable, and thus the image quality of a printed image reduces. In addition, when the moisture content of the sheet of paper is high, a demanded potential difference at the time of transfer is insufficient, and color unevenness occurs between locations on the sheet of paper or between different sheets of paper, and the image quality of the printed image reduces.

To solve the above problem, a technique for controlling an image forming condition (printing condition) according to the thickness (type) or moisture content of a sheet of paper is disclosed in JP 7-196207 A (published on Aug. 1, 1995), JP 2006-52069 A (published on Feb. 23, 2006), and JP 2016-102867 A (published on Jun. 2, 2016).

In the technique disclosed in JP 7-196207 A (published on Aug. 1, 1995), the amount of light transmitted through a sheet of paper is detected by a light projector and a light receiver, and the type of sheet of paper is determined based on the detection result. In the technique disclosed in JP 2006-52069 A (published on Feb. 23, 2006), the reflectivity of light reflected by a sheet of paper is calculated by a moisture sensor, and the moisture content of the sheet of paper is calculated from the calculated reflectivity. The determination device disclosed in JP 2016-102867 A (published on Jun. 2, 2016) includes a detection unit for detecting a characteristic value indicating a physical characteristic of a sheet of paper, a measuring unit for measuring the moisture content of the sheet of paper, and a determination unit for determining the type of sheet of paper based on the measured moisture content and the detected characteristic value.

SUMMARY

In the techniques disclosed in JP 7-196207 A (published on Aug. 1, 1995) and JP 2006-52069 A (published on Feb. 23, 2006), as the image forming conditions are set based only on the type of sheet of paper or the moisture content of the sheet of paper, the image forming conditions may not be properly set. Further, in the determination device disclosed in JP 2016-102867 A (published on Jun. 2, 2016), instead of directly measuring the moisture content of the sheet of paper, the moisture content of the sheet of paper is estimated from the temperature and humidity of the surrounding air.

Accordingly, the moisture content of the sheet of paper may not be calculated with a high accuracy.

The present disclosure has been made in view of the above issues, and has an object to provide an image forming apparatus and an image forming method that are capable of determining a type and a moisture content of a sheet of paper with high accuracy and that care capable of controlling an image forming condition, accordingly.

To address the above issues, an image forming apparatus according to an embodiment of the present invention includes a measuring unit configured to include at least one light source, to irradiate a sheet of paper with light emitted by the at least one light source, to receive the light transmitted through the sheet of paper or reflected by the sheet of paper, and to measure an intensity of the light that has been received; a type determination unit configured to determine a type of the sheet of paper, based on the intensity of the light measured by the measuring unit; a moisture content calculation unit configured to calculate a moisture content of the sheet of paper, based on the type of the sheet of paper determined by the type determination unit and the intensity of the light measured by the measuring unit; and a setting unit configured to set an image forming condition for the sheet of paper, based on the type of the sheet of paper determined by the type determination unit and the moisture content of the sheet of paper calculated by the moisture content calculation unit.

To address the above issues, an image forming method according to an embodiment of the present invention includes: irradiating light emitted by at least one light source onto a sheet of paper, receiving light transmitted through the sheet of paper or reflected by the sheet of paper, and measuring an intensity of the received light; determining a type of the sheet of paper, based on the intensity of the light measured in the measuring; calculating a moisture content of the sheet of paper, based on the type of the sheet of paper determined in the determining and the intensity of the light measured in the measuring; and setting an image forming condition for the sheet of paper based on the type of the sheet of paper determined in the determining and the moisture content of the sheet of paper calculated in the calculating.

According to an embodiment, the type and the moisture content of a sheet of paper are determined with high accuracy, and image forming conditions are controlled accordingly.

BRIEF DESCRIPTION OF THE DRAWINGS

The invention will be described with reference to the accompanying drawings, wherein like numbers reference like elements.

FIG. 9 is a diagram illustrating an example of a determination model according to a first embodiment.

FIG. 12 is a diagram illustrating a relational database used in setting image forming conditions by an image forming condition setting unit provided in the copying machine.

DESCRIPTION OF EMBODIMENTS

First Embodiment

Hereinafter, a copying machine 1A that serves as an image forming apparatus in a first embodiment of the present invention will be described in detail with reference to FIG. 1 to FIG. 12. The copying machine 1A prints image data (form an image) on a sheet of paper P.

Structure of Copying Machine 1A

Figure 1:
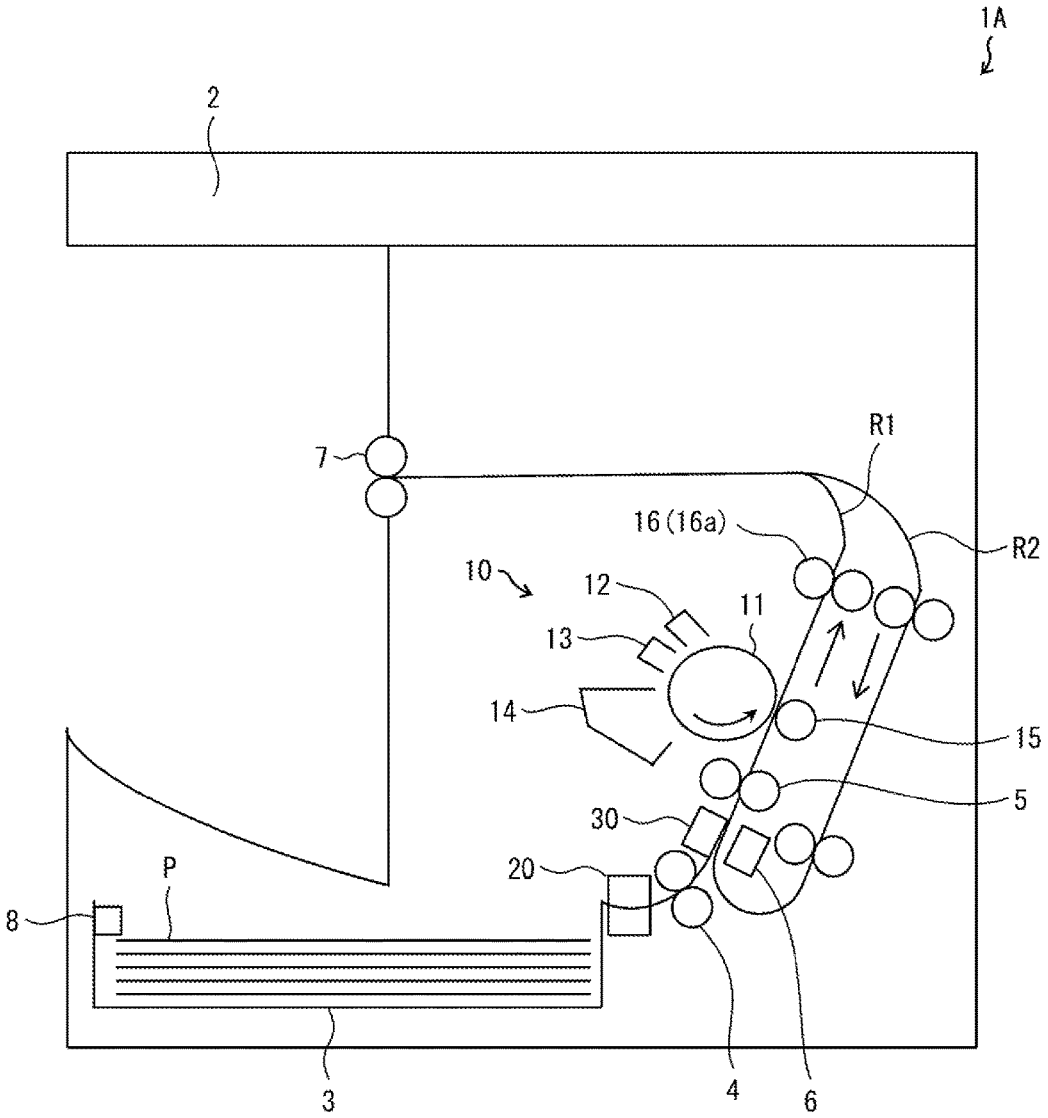
FIG. 1 is a schematic diagram illustrating a structure of a copying machine according to a first embodiment of the present invention.
Figure 2:
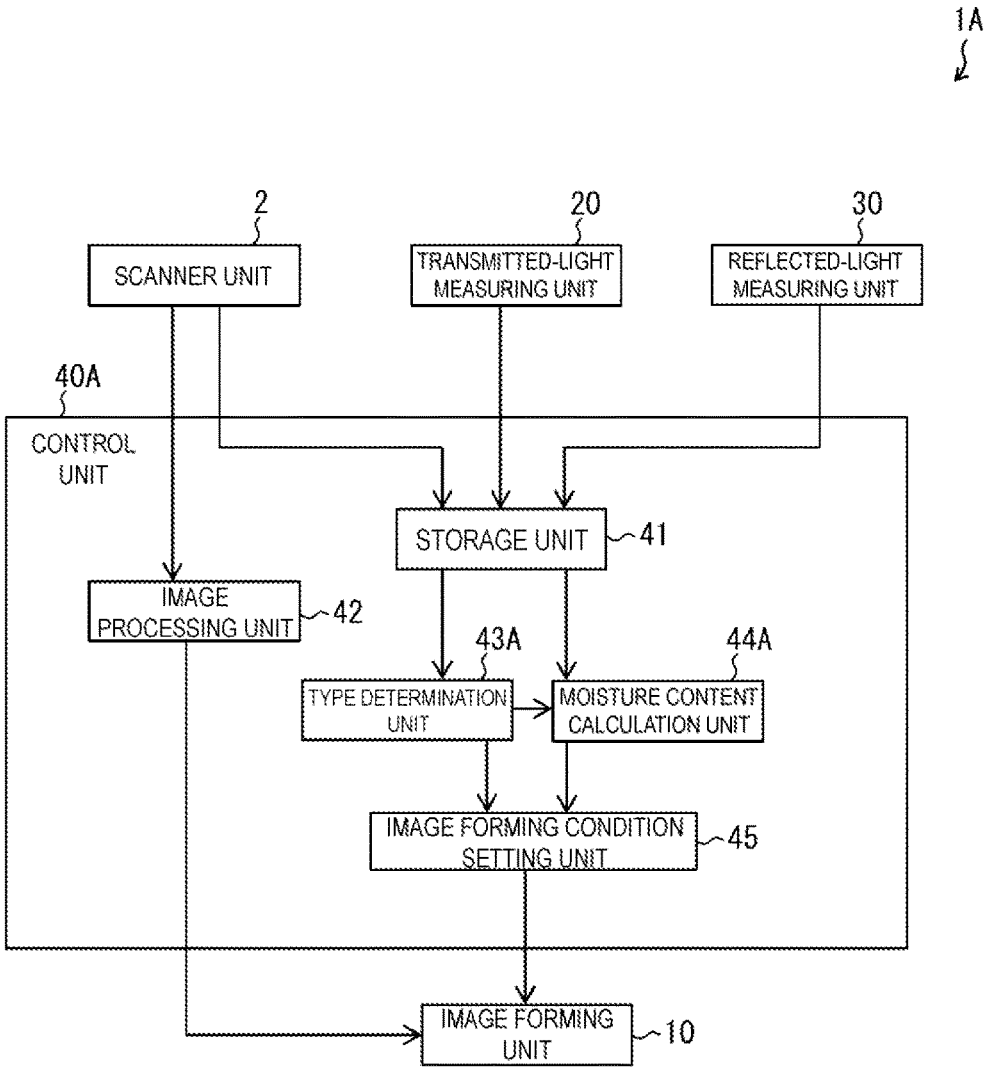
FIG. 2 is a block diagram illustrating a configuration of substantial components of the copying machine.

A configuration of the copying machine 1A will be described with reference to FIG. 1 and FIG. 2. FIG. 1 is a schematic diagram illustrating a structure of the copying machine 1A. FIG. 2 is a block diagram illustrating a configuration of substantial components of the copying machine 1A.

As illustrated in FIG. 1 and FIG. 2, the copying machine 1A includes a scanner unit 2, a paper cassette 3, a pickup roller (take-out roller) 4, a pre-resist detection unit (not illustrated), an idle roller (holding roller) 5, an image forming unit 10, a transmitted-light measuring unit (measuring unit, first measuring unit) 20, a reflected-light measuring unit (measuring unit, second measuring unit) 30, a standard reflective plate (reflective plate) 6, a sheet discharging roller 7, an environment measuring unit 8, and a control unit 40A.

The scanner unit 2 is configured to read image data (original document data) of original documents placed on an original document tray (not illustrated). The scanner unit 2 transmits the image data that has been read to a storage unit 41 or an image processing unit 42 of the control unit 40A, to be described later.

The paper cassette 3 serves as a container for containing one or more sheets of paper P to be printed on by the copying machine 1A.

The pickup roller 4 serves as a roller for feeding the sheet of paper P contained in the paper cassette 3 to a primary conveyance path R1. Note that the primary conveyance path R1 serves as a conveyance path starting from the paper cassette 3, passing through the image forming unit 10 to be described later, and ending at the sheet discharging roller 7.

The pre-resist detection unit is a switch provided between the below-described reflected-light measuring unit 30 and the idle roller 5 in the primary conveyance path R1. When it is detected that the sheet of paper P fed by the pickup roller 4 has passed, the pre-resist detection unit transmits a detection signal to the below-described idle roller 5. In the copying machine 1A according to the present embodiment, the pre-resist detection unit is provided between the reflected-light measuring unit 30 and the idle roller 5, but the present embodiment it is not limited to this configuration. The position where the pre-resist detection unit is provided may be any location as long as it can detect the passage of the sheet of paper P fed by the pickup roller 4 to transmit the detection signal to the idle roller 5.

The idle roller 5 may be provided between the pickup roller 4 and the below-described image forming unit 10 in the primary conveyance path R1, and serves as a roller for temporarily holding the sheet of paper P. In response to receiving the detection signal of the passage of the sheet of paper P from the pre-resist detection unit, the idle roller 5 temporarily holds the sheet of paper P and releases holding of the sheet of paper P at a predetermined timing.

The image forming unit 10 prints, the image indicated by the image data of the original document that has been read by the scanner unit 2, on the sheet of paper P. The image forming unit 10 includes a photosensitive drum (image carrier) 11, a charger 12, a laser scanning unit 13, a developer device 14, a transfer device (transfer unit) 15, a fixing unit 16, and a cleaning device (not illustrated).

Here, the basic operation of printing on the sheet of paper P by the image forming unit 10 will be described. Note that the detailed printing operation in the copying machine 1A will be described later.

In the printing process to be performed by the image forming unit 10, first, the charger 12 charges the photosensitive drum 11 uniformly at a predetermined voltage. It should be noted that the photosensitive drum 11 have a drum shape and rotate in the direction of the arrow illustrated inside the photosensitive drum 11 in FIG. 1.

Next, the laser scanning unit 13 exposes the photosensitive drum 11 to laser light. In this way, an electrostatic latent image based on the image data that has been subjected to the image processing is formed on the surface of the photosensitive drum 11.

Next, the developer device 14 attaches the toner agent (development agent) stored in the developer device 14 to the surface of the photosensitive drum 11, and develops a toner image (visible image) based on the electrostatic latent image on the surface of the photosensitive drum 11. In detail, the developer device 14 is provided with a developer roller (not illustrated) to which a developer bias can be applied. Next, the toner agent adheres to the surface of the photosensitive drum 11 due to the potential difference generated between the developer bias applied to the developing roller and the charged state of the surface of the photosensitive drum 11. As a result, a toner image based on the electrostatic latent image is developed on the surface of the photosensitive drum 11.

Next, the transfer device 15 performs a transfer process of transferring the toner image developed on the surface of the photosensitive drum 11 to the sheet of paper P. In detail, by applying a transfer potential to the transfer device 15 and supplying a transfer current, the toner image developed on the surface of the photosensitive drum 11 is transferred to the sheet of paper P. The transfer potential applied to the transfer device 15 and the current supplied to the transfer device 15 may be set by an image forming condition setting unit 45, to be described later.

Next, the fixing unit 16 fixes (adheres) the toner image transferred onto the sheet of paper P to the sheet of paper P. In detail, the fixing unit 16 includes a pressure roller 16A and a halogen lamp (not illustrated) as a heat source, and heat the sheet of paper P to which the toner image has been transferred using the halogen lamp while the sheet of paper P is pressurized with a predetermined pressure by the pressure roller 16*a*. As a result, the toner image transferred onto the sheet of paper P melts and fixes (adheres) to the sheet of paper P. The pressure at which the pressure roller 16*a* pressurizes the sheet of paper P, the current for driving the heat source (halogen lamp), and the conveyance speed of the sheet of paper P at the time of the fixing are set by the image forming condition setting unit 45, to be described later.

As described above, in the image forming unit 10, the photosensitive drum 11 carries a toner image obtained by developing an electrostatic latent image based on image data with a toner agent, and the transfer device 15 performs a transfer process of transferring the toner image onto the sheet of paper P, and thus the image indicated by the image data is printed on the sheet of paper P.

In addition, the cleaning device removes the toner agent remaining on the surface of the photosensitive drum 11 after the transfer, and the charger 12 uniformly charges the photosensitive drum 11 with a predetermined voltage, such that the photosensitive drum 11 is brought to a state in which the next printing process can be performed.

The transmitted-light measuring unit 20 irradiates light onto one sheet of sheet of paper P pulled out from the paper cassette 3 by the pickup roller 4, receive the light transmitted through the sheet of paper P, and measure the intensity of the received light. The intensity of the light measured by the transmitted-light measuring unit 20 is output to the below-described control unit 40A, and is used to determine a type of sheet of paper P in the control unit 40A.

Figure 3A:
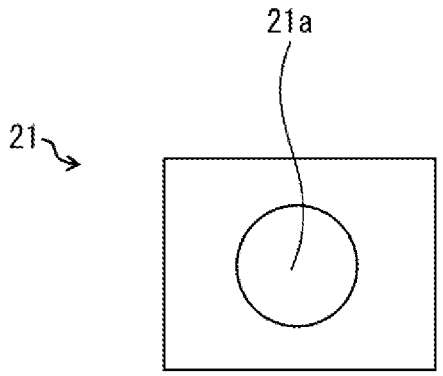
FIG. 3A is a plan view illustrating a configuration of a light radiation unit of a transmitted-light measuring unit.
Figure 3B:
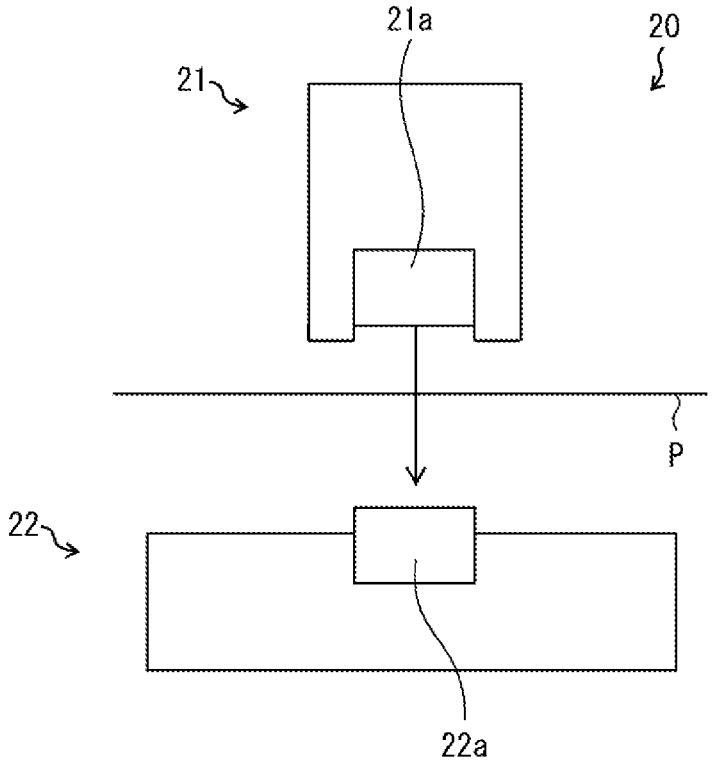
FIG. 3B is a diagram illustrating the positional relationship between the light radiation unit and a light-receiving unit of the transmitted-light measuring unit and a sheet of paper.

FIG. 3A is a plan view illustrating a configuration of a light radiation unit 21 of a transmitted-light measuring unit 20, and FIG. 3B is a diagram illustrating the positional relationship between the light radiation unit 21 and a light-receiving unit 22 of the transmitted-light measuring 20 unit and a sheet of paper. As illustrated in FIG. 3A and FIG. 3B, the transmitted-light measuring unit 20 includes a light radiation unit 21 and a light-receiving unit 22.

The light radiation unit 21 emits light to the sheet of paper P. As illustrated in FIG. 3A, the light radiation unit 21 includes a light source 21 formed of one semiconductor light emitting element (Light Emitting Diode: LED). Although the wavelength of the light irradiated (emitted) by the light source 21*a* is not particularly limited, from the viewpoint that inexpensive infrared LEDs can be used and inexpensive silicon photodiodes can be used as light-receiving elements 22*a* in the light-receiving unit 22, greater than or equal to 800 nm and less than or equal to 1100 nm may be applicable. The wavelength and the intensity of the light irradiated by the light radiation unit 21 can be appropriately selected according to the configuration of the copying machine 1A and the type of sheet of paper P to be measured.

In addition, to improve the accuracy of the determination of the type of sheet of paper P to be described later, the light irradiated from the light radiation unit 21 can be light with a small half width. Accordingly, the light source 21*a* can be provided with a wavelength filter (not illustrated) that transmits light having a wavelength in a predetermined range.

Note that, in the present embodiment, although an LED is provided as the light source 21*a* of the light radiation unit 21, the present embodiment is not limited to this. The light source of the light radiation unit in an embodiment may be any light source as long as it can irradiate light of a wavelength capable of determining the sheet of paper P and calculating the moisture content. For example, a configuration including a halogen lamp or a phosphor may be used. In the case of a light source such as a halogen lamp or a phosphor that emits light having a constant wavelength range, the light includes a plurality of wavelengths. Therefore, even in the case of a configuration including a halogen lamp or a phosphor as a light source, the light source can be provided with the wavelength filter and that the light radiation unit irradiates light having a small half width.

As illustrated in FIG. 3B, light-receiving unit 22 receives the light that has been irradiated from the light radiation unit 21 and transmitted through the sheet of paper P. The light-receiving unit 22 includes one light-receiving element 22*a*. The light-receiving element 22*a* in the present embodiment may be a photodiode. After the light-receiving element 22*a* amplifies an electric signal value having a magnitude corresponding to the intensity of the received light using an amplifier circuit (not illustrated), an AD (Analog-Digital) converter (not illustrated) converts the amplified value to a digital signal, and outputs the converted signal to the storage unit 41 of the control unit 40A. The light receiving element 22*a* is selected to detect light in a wavelength range including the wavelength of light irradiated by the light source 21*a* of the light radiation unit 21.

Although the light-receiving element 22*a* in the present embodiment is a photodiode, the copying machine in the present embodiment is not limited thereto. That is, in the copying machine of the present disclosure, the light-receiving element 22 may be a phototransistor, an avalanche photodiode, or a photomultiplier tube. However, the light-receiving element 22*a* is inexpensive and occupies less space, the light-receiving element 22*a* can be a photodiode.

In addition, the light radiation unit 21 and the light-receiving unit 22 may be waterproofed by a transparent cover member (not illustrated) having translucency. The cover member may be made of, for example, quartz glass or synthetic quartz glass.

The reflected-light measuring unit 30 may irradiate light on the sheet of paper P held by the idle roller 5, receive the light reflected by the sheet of paper P, and measure the intensity of the received light. The intensity of the light measured by the reflected-light measuring unit 30 may be output to the below-described control unit 40A, and be used for calculating the moisture content of the sheet of paper P in the control unit 40A.

Figure 4A:
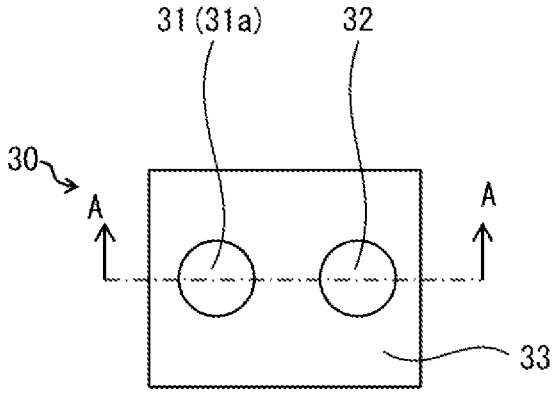
FIG. 4A is a plan view illustrating a configuration of a reflected-light measuring unit of the copying machine.
Figure 4B:
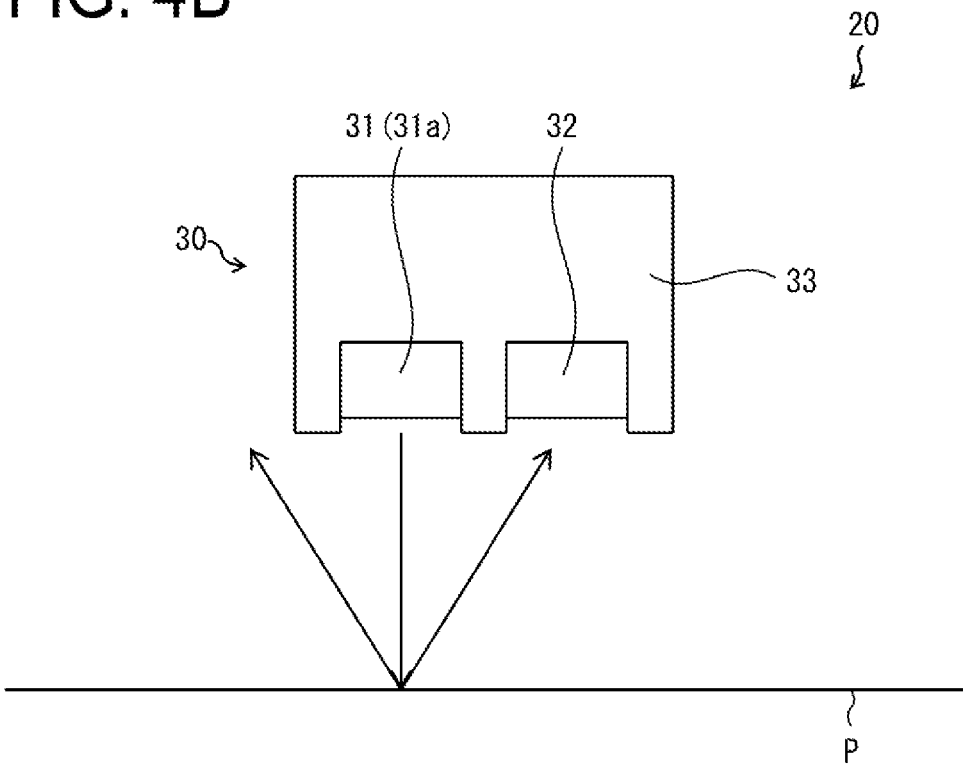
FIG. 4B illustrates the positional relationship between a light radiation unit and a light-receiving unit of a reflected-light measuring unit and a sheet of paper, and is a cross-sectional view taken along the line A-A in FIG. 4A.

FIG. 4A is a plan view illustrating a configuration of a reflected-light measuring unit 30, and FIG. 4B illustrates the positional relationship between a light radiation unit 31 and a light-receiving unit 32 of a reflected-light measuring unit 30 and a sheet of paper, and is a cross-sectional view taken along the line A-A in FIG. 4A. As illustrated in FIG. 4A and FIG. 4B, the reflected-light measuring unit 30 includes a light radiation unit 31, a light-receiving unit 32, and a housing 33 configured to house the light radiation unit 31 and the light-receiving unit 32.

The light radiation unit 31 emits light to the sheet of paper P. As illustrated in FIG. 4A, the light radiation unit 31 includes a light source 31*a* including one semiconductor light emitting element (LED: Light Emitting Diode). The configuration of the light source 31*a* is similar to the configuration of the light source 21*a* of the transmitted-light measuring unit 21, and thus the description will be omitted herein.

As illustrated in FIG. 4B, the light-receiving unit 32 may receive the light that has been irradiated from the light radiation unit 21 and reflected by the sheet of paper P. The configuration of the light-receiving unit 32 is similar to the configuration of the light-receiving unit 22 of the transmitted-light measuring unit 20, the description thereof will be omitted herein.

To prevent the light irradiated from the light radiation unit 31 from being directly received by the light-receiving unit 32, as illustrated in FIG. 4B, the light radiation unit 31 and the light-receiving unit 32 may be provided further inside of the casing 33 than the outer surface of the casing 33. In addition, the light radiation unit 31 and the light-receiving unit 32 may be waterproofed by a transparent inlaid cover member (not illustrated) having translucency. The inlaid cover member may be made of, for example, quartz glass or synthetic quartz glass.

The standard reflective plate 6 serves as a reflective plate for reflecting the light irradiated from the light radiation unit 31 of the reflected light measuring unit 30 to the light-receiving unit 32 of the reflected-light measuring unit 30, when no sheet of paper P is present between the reflected-light measuring unit 30 and the standard reflecting plate 6. The standard reflective plate 6 can be provided to face the reflected-light measuring unit 30. In the copying machine 1A according to the present embodiment, the standard reflective plate 6 is provided at a position opposite to the reflected-light measuring unit 30 with respect to the primary conveyance path R1. However, in the copying machine in the present embodiment, the location where the standard reflective plate 6 is provided is not limited to such a configuration. The location where the standard reflective plate 6 is provided may be any location as long as the light that has been irradiated from the light radiation unit 31 and reflected by the standard reflective plate 6 is directly received by the light-receiving unit 32 without being blocked. In addition, configurations in which the standard reflective plate 6 may be incorporated inside the reflected-light measuring unit 30 are also applicable. The standard reflective plate 6 may be made of a material having a high reflectance, and in the present embodiment, it may be made of polytetrafluoroethylene (PTFE). The intensity of the light irradiated from the light radiation unit 31, reflected by the surface of the standard reflective plate 6, and received by the light-receiving unit 32 can be used as reference data for calculation of the moisture content of the sheet of paper P to be described later.

The sheet discharging roller 7 serves as a roller for ejecting the printed sheet of paper P to a sheet discharging tray (not illustrated). The sheet discharging roller 7 is configured to be rotatable in both the direction in which the sheet of paper P is ejected to the outside as well as the opposite direction.

The environment measuring unit 8 is provided in the paper cassette 3, and may be configured to measure the temperature around the sheet of paper P contained in the paper cassette 3. Note that, in the copying machine according to one embodiment, the location where the environment measuring unit 8 is provided is not limited to the location depicted in FIG. 1, but may be any position where the temperature can be measured around the sheet of paper P contained in the paper cassette 3. The temperature measured by the environment measuring unit 8 can be used in setting the image forming conditions to be described later.

In addition, the copying machine 1A includes a secondary conveyance path R2. The secondary conveyance path R2 may be a conveyance path used for printing a plurality of times (for example, on both sides) with respect to the sheet of paper P. The secondary conveyance path R2 may branch out from the primary conveyance path R1 between the fixing unit 16 and the sheet discharging roller 7, and serves as a conveyance path for connecting from the branch point to the pickup roller 4 and the reflected-light measuring unit 30 in the primary conveyance path R1.

A branching claw may be provided at the branch point, such that the branching claw can be operated for two sides. When the branching claw is operated on one side (the primary conveyance path R1 side), the sheet of paper P that passed through the fixing section 16 may be conveyed to the sheet discharging roller 7. Conversely, by operating the branching claw on the other side (the secondary conveyance path R2 side) and rotating the sheet discharging roller 7 in a direction opposite to the direction in which the sheet of paper P is ejected to the sheet discharging tray, the sheet of paper P is conveyed to the output roller 7, is then conveyed in a direction opposite to the transport direction of the primary conveyance path R1 (that is, it is switched back), and is conveyed from the branch point to the secondary conveyance path R2. The sheet of paper P conveyed to the secondary conveying path R2 may be conveyed between the pickup roller 4 and the reflected-light measuring unit 30 in the primary conveyance path R1 via the secondary conveyance path R2. In this situation, the front and back sides of the sheet of paper P is reversed from the case where the sheet of paper P has passed through the image forming unit 10 last time, and in addition, the sheet of paper P is reversed upside-down. As a result, printing can be performed on the sheet of paper P a plurality of times.

The control unit 40A controls the operation of each of the above units. In addition, the control unit 40A includes a storage unit 41, an image processing unit 42, a type determination unit 43A, a moisture content calculation unit 44A, and an image forming condition setting unit (setting unit) 45.

The storage unit 41 is configured to store information necessary for printing in the copying machine 1A. To be specific, the storage unit 41 may include: an area for temporarily storing the image data read by the scanner unit 2; various programs to be executed by the image processing unit 42, the type determination unit 43A, the moisture content calculation unit 44A, and the image forming condition setting unit 45 (for example, a program for performing a printing process, determining the type of sheet of paper P, and calculating the moisture content on the surface of the sheet of paper P); an area for storing data used in the programs; an area where the programs are loaded; and a work area to be used when a program is executed. Further, the storage unit 41 may include an area for storing: internal control data for the copying machine 1A such as the voltage and current supplied and applied to each element of the image forming unit 10, which may be modified according to conditions set by a user; and various models used for determining the type of sheet of paper P and calculating the moisture content of the surface of the sheet of paper P.

The image processing unit 42 performs image processing on image data that has been read by the scanner unit 2 or image data that has been read by the scanner unit 2 and stored in the storage unit 41. The image processing unit 42 outputs the image data that has been subjected to the image processing to the image forming unit 10.

The type determination unit 43A may determine the type of sheet of paper P, based on the intensity of the light measured by the transmitted-light measuring unit 20. The moisture content calculation unit 44A may calculate the moisture content of the surface of the sheet of paper P, based on the type of sheet of paper P that has been determined by the type determination unit 43A and the intensity of the light that has been measured by the reflected-light measuring unit 30. The image forming condition setting unit 45 may set the image forming conditions for the sheet of paper P, based on the type of sheet of paper P that has been determined by the type determination unit 43A and the moisture content of the surface of the sheet of paper P that has been calculated by the moisture content calculation unit 44. The details of the method by the type determination unit 43A for determining a type of sheet of paper P, the method by the moisture content calculation unit 44A for calculating the moisture content of the sheet of paper P, and the method by the image forming condition setting unit 45 for setting an image forming condition will be described later.

Printing Operation of Copying Machine 1A

Figure 5:
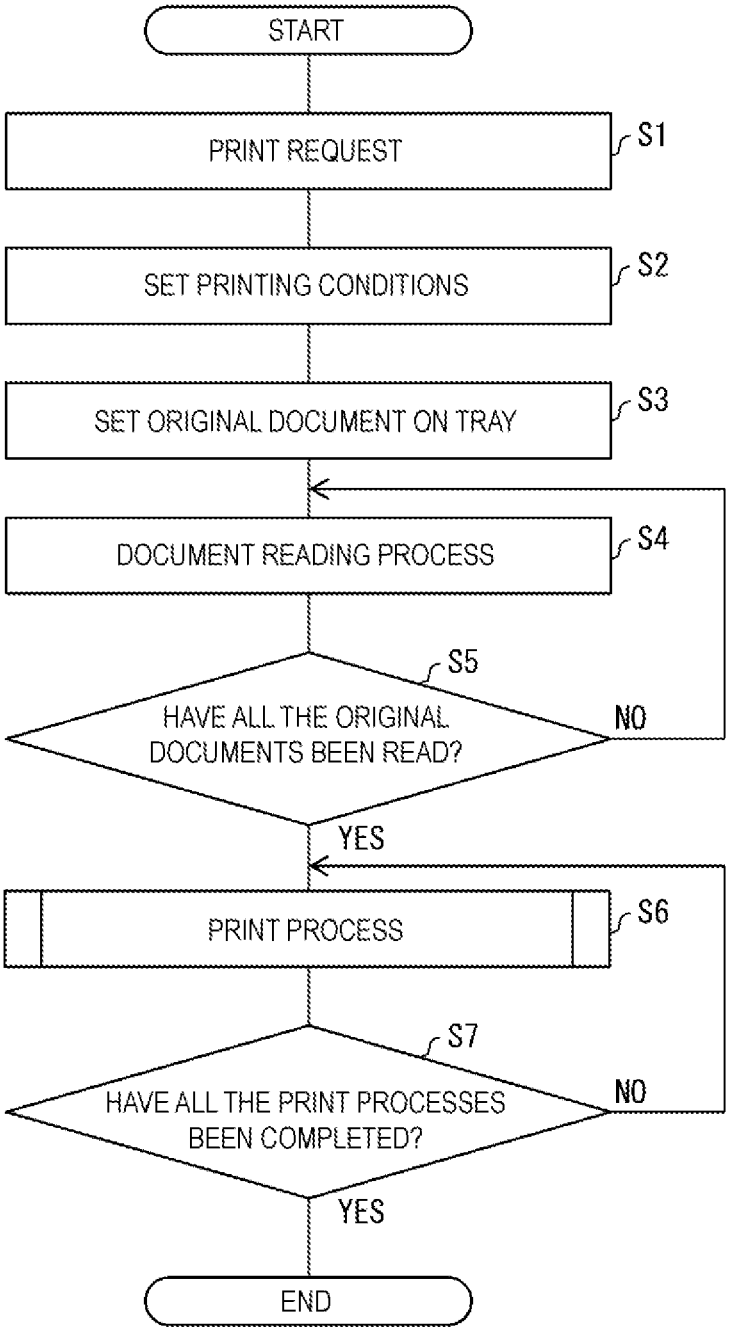
FIG. 5 is a flowchart illustrating an example of a flow of a process of performing double-sided printing on a sheet of paper by using a copying machine.

Next, a printing operation (image forming method) of the copying machine 1A will be described with reference to FIG. 5. Herein, an operation for performing double-sided printing on the same sheet of paper P by using the copying machine 1A will be described. FIG. 5 is a flowchart illustrating an example of a flow of a process of performing double-sided printing on a sheet of paper P by using a copying machine 1A. Note that the operation described below may be controlled by the control unit 40A, unless otherwise specified. In addition, in the following description, it is assumed that one side of the sheet of paper P is a first side and the other side is a second side.

As illustrated in FIG. 5, when a print request (image formation request) is made by a user (S1), the copying machine 1A sets printing conditions including the number of sheets of paper to be printed, a print magnification, a size of the sheet of paper P, single-sided or double-sided printing, and the like that have been decided by the user.

Next, the user places an original document on the original document tray of the scanner unit 2 (S3). Note that this step may be performed before a print request is issued by the user (that is, prior to S1).

Next, the scanner unit 2 reads original document data (image data) (S4). Herein, an operation of reading image data of both sides (the front side and back side) of an original document will be described. In the operation of reading the image data, the scanner unit 2 reads the image data of the front side of the original document. The image data of the read front side is transmitted to the storage unit 41 and stored in the storage unit 41. Next, the scanner unit 2 reads the image data from the back side of the original document. The image data of the read back side is sent to the image processing unit 42 without being sent to the storage unit 41. The image data of the back side of the original document sent to the image processing unit 42 is subject to the image processing performed by the image processing unit 42, is sent to the laser scanning unit 13 of the image forming unit 10, and is used for printing the first side of the sheet of paper P. Subsequently, the image data of the front side of the original document stored in the storage unit 41 may be sent to the image processing unit 42. The image data of the front side of the original document sent to the image processing unit 42 may be subject to the image processing performed by the image processing unit 42, sent to the laser scanning unit 13 of the image forming unit 10, and is used for printing the second side of the sheet of paper P.

Next, the control unit 40A determines whether image data for all the original documents has been read (S5). In the event that there are still original documents that should be read (NO in S5), image data of the next original document is read (that is, step S4 is repeated).

In contrast, in the event that reading image data for all the original documents is completed (YES in S5), the copying machine 1A performs printing on the sheet of paper P (S6, printing process). Details of the printing process (S6) on the sheet of paper P to be performed by the copying machine 1A will be described later.

Next, the control unit 40A may determine whether the printing process requested by the user has been completed (S7). In the event that the requested printing has not been completed (NO in S7), specifically when there are a plurality of print requests for a single original document and the requested number of sheets is not printed, or when printing of another original document has not been completed, Step S6 may be repeated. In contrast, when the requested printing has been completed (YES in S7), all the printing processes are completed, and the copying machine 1A enters a standby state.

Printing Process of Copying Machine 1A

Figure 6:
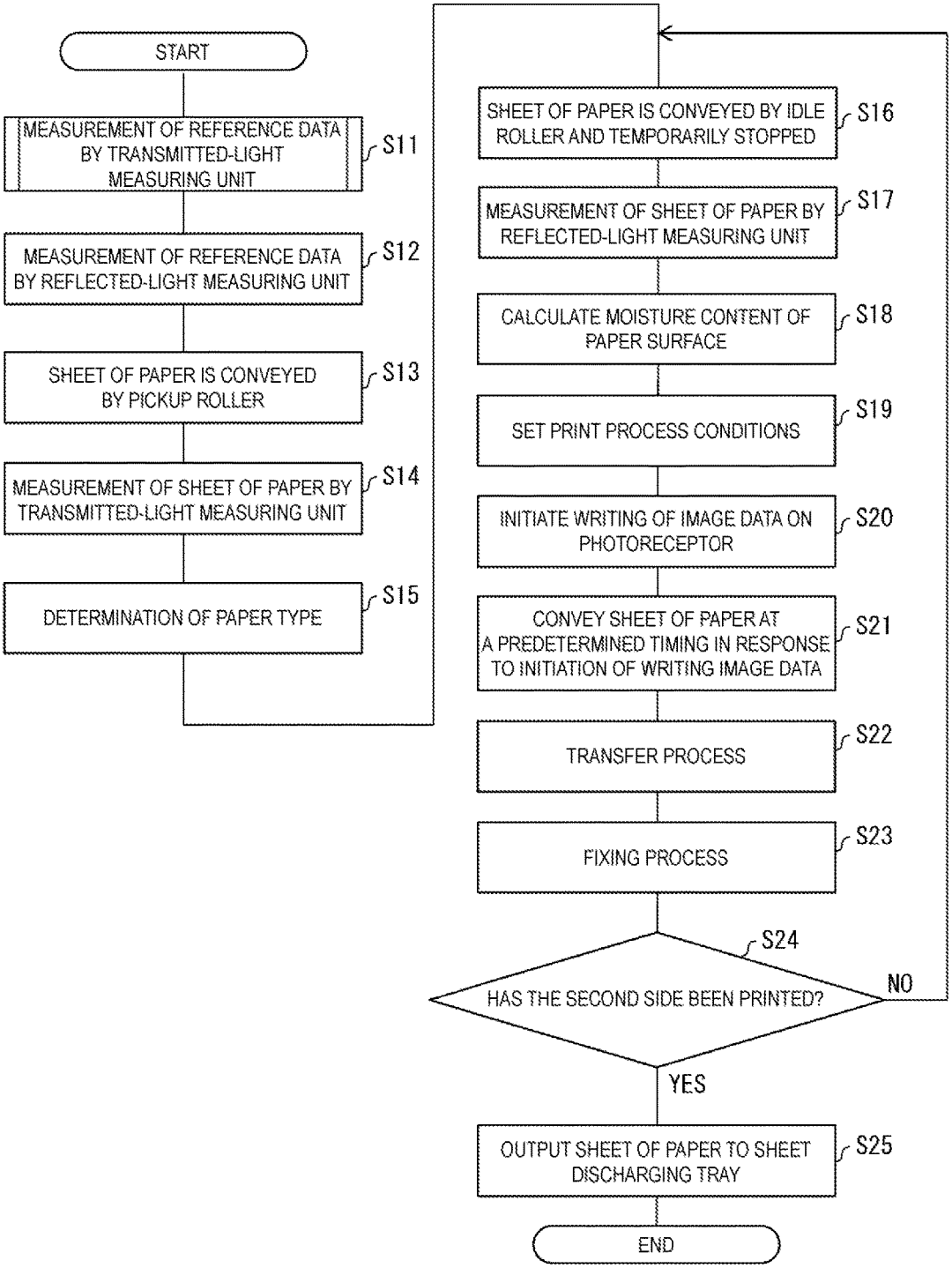
FIG. 6 is a flowchart illustrating an example of a flow of a printing process in the copying machine.

Next, the details of the printing process (S6) on the sheet of paper P by the copying machine 1A will be described with reference to FIG. 6. FIG. 6 is a flowchart illustrating an example of a flow of the printing process in the copying machine 1A.

Figure 7:
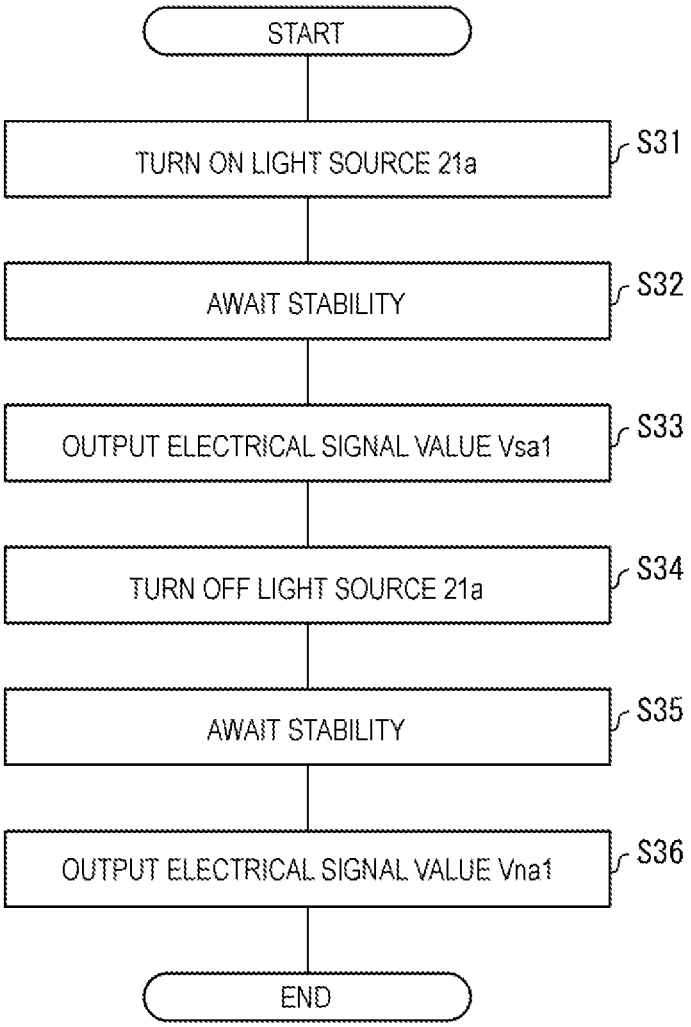
FIG. 7 is a flowchart illustrating an example of a flow of a process of measuring reference data by the transmitted-light measuring unit.

In the printing process (S6) on the sheet of paper P by the copying machine 1A, first, the transmitted-light measuring unit 20 measures the reference data (S11, measuring step). FIG. 7 is a flowchart illustrating an example of a flow of a process of measuring reference data (S11) by the transmitted-light measuring unit 20.

In the measuring of the reference data by the transmitted-light measuring unit 20 (S11), as illustrated in FIG. 7, first, the light source 21 of the light radiation unit 21 is made to turn on in a state where there is no sheet of paper P present between the light radiation unit 21 and the light receiving unit 22 (S31). Next, the light emission state of the light source 21 stabilizes, and waits for a predetermined time (in the present embodiment, 20 ms) until outputs from the amplifier circuit become constant (S32). Note that the standby time until the outputs from the light source 21 become stable and the outputs from the amplifier circuit become constant may be appropriately adjusted in accordance with the specifications of the light source 21*a* or the amplifier circuit. Next, the light-receiving unit 22 directly receives the light irradiated from the light source 21*a*, and outputs an electric signal value Vtsa1 having a magnitude corresponding to the intensity of the received light to the storage unit 41 (S33). Next, the light source 21*a* is made to turn off (S34), and a predetermined time (in the present embodiment, 20 ms) is waited, until the outputs from the amplifier circuit become constant (S35). Next, the light-receiving unit 22 measures the intensity of the light (that is, the intensity of the background light), and outputs an electric signal value Vtna 1 having a magnitude corresponding to the measured light intensity, to the storage unit 41 (S36).

Next, as illustrated in FIG. 6, the reflected-light measuring unit 30 measures the reference data (S12, measuring step). To be specific, in a state where there is no sheet of paper P present between the reflected-light measuring unit 30 and the standard reflective plate 6, the light radiation unit 31 of the reflected-light measuring unit 30 irradiate the standard reflective plate 6 with light, and the light-receiving unit 32 receives the light reflected by the standard reflective plate 6. The details are substantially the same as step S11 (FIG. 7), and thus the description will be omitted herein. In this way, the light-receiving unit 32 outputs an electric signal value Vrsa1 having a magnitude corresponding to the intensity of the light reflected by the standard reflective plate 6 and an electric signal value Vrna1 having a magnitude corresponding to the intensity of the background light to the storage unit 41.

Next, the pickup roller 4 take out one sheet of paper P contained in the paper cassette 3 and transport the sheet of paper P to the primary conveyance path R1 (S13).

Next, the transmitted-light measuring unit 20 measures the sheet of paper P that has been taken out by the pickup roller (S14, measuring step). With the exception of the fact that there is a sheet of paper P between the light radiation unit 21 and the light-receiving unit 22, the measuring of the sheet of paper P by the transmitted-light measuring unit 20 is substantially similar to the measuring in Step S11, and thus the description will be omitted herein. In this way, the light-receiving unit 22 outputs to the storage unit 41 an electric signal value Vtsa2 having a magnitude corresponding to the intensity of the light transmitted through the sheet of paper P and an electric signal value Vtna 2 having a magnitude corresponding to the intensity of the background light.

Note that, the thickness and the surface properties of the sheet of paper P are not usually uniform, and there is unevenness between the locations of the sheet of paper P, and thus may affect the determination of the type of sheet of paper P, as will be described later. Accordingly, the transmitted-light measuring unit 20 can measure the sheet of paper P at a plurality of positions (in the present embodiment, at two locations). To be specific, by fixing the position of the transmitted-light measuring unit 20, and moving the sheet of paper P by using the pickup roller 4, a measurement position on the sheet of paper P may be changed. This reduces impacts of the unevenness. Note that, in the present embodiment, the transmitted-light measuring unit 20 performs the measurement while moving the pickup roller 4, but the measurement may also be performed in a state in which the sheet of paper P is temporarily held by the pickup roller 4 and the sheet of paper P is kept stationary. In this case, the time required for the measurement may increase, but since the intensity of the light transmitted through the sheet of paper P is measured with high accuracy, the type of sheet of paper P is determined with high accuracy, as will be described later. In addition, changing of the measurement position on the sheet of paper P is not limited to the above method, and may be performed by moving the transmitted-light measuring unit 20 without moving the sheet of paper P.

Next, the type determination unit 43A determines a type of sheet of paper P based on the intensity of the light that has been measured by the transmitted-light measuring unit 20 (S15, a type determination process). A detailed description of the method for determining the type of sheet of paper P by the type determination unit 43A will be described later.

Next, when the sheet of paper P is conveyed further along the primary conveyance path R1, the pre-resist detection unit detects passing of the sheet of paper P and transmits a detection signal to the idle roller 5. In response to receiving the detection signal from the pre-resist detection unit, the idle roller 5 temporarily holds the sheet of paper P that has been conveyed through the primary conveyance path R1 (S16).

Next, the reflected-light measuring unit 30 measures the sheet of paper P being held by the idle roller 5 (S17, measuring step). With the exception of the fact that the light reflected by the sheet of paper P is measured instead of that of the standard reflective plate 6, the measurement of the sheet of paper P by the reflected-light measuring unit 30 is substantially similar to the measurement in Step S12, the description will be omitted herein. In this way, the light-receiving unit 32 may output an electric signal value Vrsa2 having a magnitude corresponding to the intensity of the light reflected by the sheet of paper P and an electric signal value Vrna2 having a magnitude corresponding to the intensity of the background light to the storage unit 41.

Note that the sheet of paper (sheet of paper P) typically has a property such that the end portions contain moisture more easily than the center portion. That is, the moisture content of the sheet of paper P varies depending on the location. Accordingly, to mitigate the impact of the distribution in moisture content of the sheet of paper P, the copying machine 1A according to the present embodiment may measure the sheet of paper P at a plurality of locations by using the reflected-light measuring unit 30. Here, the irradiation locations of light on the sheet of paper P by the reflected-light measuring unit 30 will be described with reference to FIG. 8.

Figure 8:
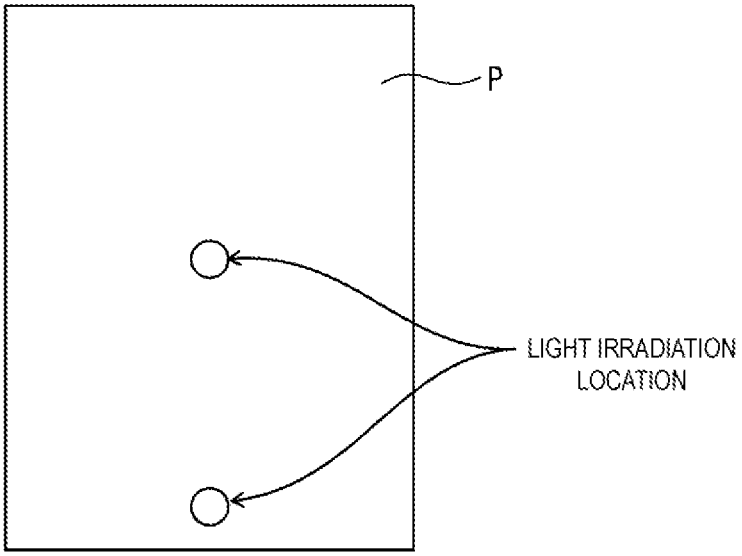
FIG. 8 is a top view of a sheet of paper illustrating light irradiation locations on the sheet of paper by the reflected-light measuring unit.

FIG. 8 is a top view of a sheet of paper P illustrating light irradiation locations on the sheet of paper by the reflected-light measuring unit 30. As illustrated in FIG. 8, the reflected-light measuring unit 30 in the present embodiment irradiates light onto the sheet of paper P at two locations. To be specific, first, the reflected-light measuring unit 30 irradiates the sheet of paper P being held by the idle roller 5 with light, and performs a first measurement. Next, the idle roller 5 conveys the sheet of paper P by a predetermined amount, and holds the sheet of paper P once again. Then, the reflected-light measuring unit 30 irradiates the sheet of paper P with light at a location that is different from the location irradiated the first time, and performs a second measurement. As illustrated in FIG. 8, the irradiation location of the first time and the irradiation location of the second time may be set to locate at the center portion of the sheet of paper P in one of the first time or the second time and to locate at an end portion of the sheet of paper P in the other one of the first time or the second time. That is, the reflected-light measuring unit 30 measures the intensity of the light reflected by the surface of the sheet of paper P at the center portion and at the end portion of the sheet of paper P. In this way, in the calculation of the moisture content of the surface of the sheet of paper P to be described later, an impact of the distribution in moisture content on the surface of the sheet of paper P is reduced by, for example, calculating the moisture content on the surface of the sheet of paper P using an average value of the first measurement result and the second measurement result. It should be noted that three or more light irradiation locations to be measured by the reflected-light measuring unit 30 may be provided on the sheet of paper P. Note that, in the present embodiment, although the position of the reflected-light measuring unit 30 is fixed and the measurement location on the sheet of paper P is varied by moving the sheet of paper P using the idle roller 5, the present embodiment is not limited to this. The image forming device according to one embodiment may be configured to vary the measurement location on the sheet of paper P by moving the reflected-light measuring unit 30 without moving the sheet of paper P.

Next, as illustrated in FIG. 6, the moisture content calculation unit 44A may calculate the moisture content of the surface of the first side of the sheet of paper P (S18, moisture content calculation step). A detailed description of the method for calculating the moisture content of the surface of the sheet of paper P will be given later.

Next, in addition to the printing conditions decided by the user and the temperature measured by the environment measuring unit 8, the image forming condition setting unit 45 sets image forming conditions for the sheet of paper P (to be specific, a transfer condition (a voltage to be supplied to the transfer device 15 and a current value to be applied to the transfer device 15), and a fixing condition (a pressure at which the pressure roller 16*a* presses the sheet of paper P, a current to drive a heat source (halogen lamp), and a conveyance speed of the sheet of paper P at the time of fixing)) based on the type of sheet of paper P that has been determined by the type determination unit 43A and the moisture content on the surface of the sheet of paper P that has been calculated by the moisture content calculation unit 44A (S19, configuration step). Further details of the setting of the image forming conditions by the image forming condition setting unit 45 will be described later. The image forming conditions set by the image forming condition setting unit 45 may be output to the transfer device 15 and the fixing unit 16, respectively.

Next, writing of image data on the surface of the photosensitive drum 11 is initiated (S20). To be specific, first, the laser scanning unit 13 forms an electrostatic latent image of the image data that has been processed by the image processing unit 42, on the surface of the photosensitive drum 11 charged by the charger 12. Next, the developer device 14 initiates an operation of adhering the toner agent to the electrostatic latent image and developing the toner image. After writing of the image data on the surface of the photosensitive drum 11 is initiated, a process for writing the image data is continued.

Next, when writing of the image data on the surface of the photosensitive drum 11 is initiated, the idle roller 5 releases holding of the sheet of paper P at a predetermined timing. That is, holding of the sheet of paper P by the idle roller 5 may be released such that the toner image developed on the photosensitive drum 11 is transferred by the transfer device 15 to a predetermined location on the sheet of paper P.

Next, the transfer device 15 transfers the toner image developed on the photosensitive drum 11 to the first side of the sheet of paper P (S22). Here, the transfer voltage supplied to the transfer device 15 and the transfer current applied to the transfer device 15 respectively serve as the transfer voltage and the transfer current that have been set by the image forming condition setting unit 45.

Next, the fixing unit 16 fixes the toner image, which has been transferred onto the first side of the sheet of paper P by the transfer device 15, onto the sheet of paper P (S23). The pressure at which the pressure roller 16*a* pressurizes the sheet of paper P, the current for driving the heat source (halogen lamp), and the conveyance speed of the sheet of paper P at the time of fixing can be set by the image forming condition setting unit 45. As a result, printing on the first side of the sheet of paper P is completed.

Next, the control unit 40A determines whether the printing has been performed on the second side of the sheet of paper P (S24).

When printing on the second side has not been completed (NO in S24), the sheet of paper P in which the first side has been subjected to the printing process is conveyed on the primary conveyance path R1 by the rotation of the sheet discharging roller 7, and reaches the sheet discharging roller 7. When the sheet of paper P reaches the sheet discharging roller 7, the sheet of paper P may be temporarily idle in a state in which the rear end portion in the output direction is sandwiched by the sheet discharging roller 7. Next, the control unit 40A switches the branch point to the secondary conveyance path R2 side. Next, the control unit 40A rotates the sheet discharging roller 7 in the opposite direction as before to convey the sheet of paper P to the secondary conveyance path R2. In this way, the sheet of paper P is conveyed between the pickup roller 4 and the reflected-light measuring unit 30 on the primary conveyance path R1, in a state in which the first surface and the second surface are reversed and the top and bottom are reversed from the case of passing by the image forming unit 10 last time. Then, Steps S16 to S23 are performed on the second side of the sheet of paper P, and printing is performed on the second side. It should be noted that a portion of the moisture on the surface of the sheet of paper P may evaporate when the fixing unit 16 performs the first fixing process. As a result, the moisture content of the surface of the second side of the sheet of paper P may be lower than the moisture content of the surface of the sheet of paper P in the printing process on the first side. Therefore, in the copying machine 1A according to the present embodiment, before the printing process is performed on the second side of the sheet of paper P, the moisture content of the surface on the second side of the sheet of paper P may be calculated to set the transfer condition and the fixing condition based on the calculated moisture content. In this way, the image quality of the images printed on the first side and the second side of the sheet of paper P is made uniform.

When the printing on the second side is completed (YES in S24), the branching claw may be switched to the primary conveyance path R1 side, and the sheet of paper P may be conveyed from the fixing unit 16 to the sheet discharging roller 7. Note that switching of the branching claws may be performed at any time as long as it is after the sheet of paper P has been conveyed to the secondary conveyance path R2. Next, the sheet of paper P may pass through the sheet discharging roller 7 and be ejected to the output tray (S25). Thus, the printing process (S6) on a sheet of sheet of paper P by the copying machine 1A is completed.

Determination of the Type of Sheet of Paper P

Next, with reference to FIG. 9 and FIG. 10, a description will be given of a method (Step S15 in FIG. 6) for determining the type of sheet of paper P by the type determination unit 43A. Note that the type of sheet of paper P primarily includes a thickness and a basis weight of the sheet of paper P.

First, the type determination unit 43A calculates a reference received-light intensity Vt0*a*, which is an intensity of the received light in a state where there is no sheet of paper P present between the light radiation unit 21 and the light-receiving unit 22. Note that the received light intensity denotes the difference between the electric signal value of a magnitude corresponding to the intensity of the light received by the light-receiving unit 32 when the light source (for example, the light source 21) is turned on, and the electric signal value of a magnitude corresponding to the intensity of the light received by the light receiving unit 32 when the light source is turned off. To be specific, the type determination unit 43A reads the electric signal value Vtsa1 and an electric signal value Vtna1 measured in Step S11 from the storage unit 41, calculates the reference received-light intensity Vt0*a* using Expression 1 below, and outputs the reference received-light intensity Vt0A that has been calculated, to the storage unit 41.

$$Vt0a=Vtsa1-Vtna1 \quad (1).$$

Next, the type determination unit 43A calculates a received-light intensity Vta, which serves as a received-light intensity in a state where the sheet of paper P is present between the light radiation unit 21 and the light-receiving unit 22. To be specific, the type determination unit 43A reads the electric signal value Vtsa2 and an electric signal value Vtna2 measured in Step S14 from the storage unit 41, calculates the received-light intensity Vta using Expression 2 below, and outputs the received-light intensity Vta that has been calculated, to the storage unit 41. The received-light intensity Vta is calculated by using the intensity of the light transmitted through the sheet of paper P, and thus the received-light intensity Vta includes information on the type (thickness or basis weight) of the sheet of paper P.

$$Vta=Vtsa2-Vtna2 \quad (2).$$

Note that, in the present embodiment, as described above, as the measurements are performed at two locations on the sheet of paper P in step S14, the average value of the received-light intensities at the above two locations is output to the storage unit 41, as the received-light intensity Vta.

Next, the type determination unit 43A calculates an absorbance Ata of the sheet of paper P. To be specific, the type determination unit 43A reads the reference received-light intensity Vt0*a* and the received-light intensity Vta from the storage unit 41, and applies the Lambert-Beer rule to the received-light intensity Vta as indicated in Expression 3 below to calculate the absorbance Ata of the sheet of paper P.

$$Ata=\log(Vt0a/Vta) \quad (3).$$

The above log is a common logarithm (logarithm with a base 10). Note that, in the present embodiment, although the absorbance Ata of the sheet of paper P is calculated by using the Lambert-Beer rule, the image forming apparatus of the present disclosure is not limited to this configuration. For example, the absorbance Ata of the sheet of paper P may be calculated by using the Kubelka-Munch rule.

Next, the type determination unit 43A calculates an index that indicates a characteristic of the type of sheet of paper P by using the absorbance Ata that has been calculated. Examples of the above index may include any one of a similarity (a similarity degree between measured samples), a separability (a separation degree of the characteristics between the measured samples), and a probability (a degree obtained by predicting the distribution of the characteristics of the measured samples and stochastically determining whether the distribution falls within an allowable range of the distribution of other samples or is sufficiently distinguishable, that is, a degree of whether the characteristics can be regarded as similar or the same). Note that the index can be appropriately selected according to the type of sheet of paper P.

To be specific, the type determination unit 43A first reads out a calculation model from the storage unit 41 to calculate an index indicating a characteristic of the type of sheet of paper P. Examples of a derivation method of the calculation model may include support vector machines, pattern recognition, cluster analysis, analysis by Mahalanobis distance, Soft Independent Modeling of Class Analysis (SIMCA), discriminant analysis, canonical discriminant analysis methods, and the like. Which derivation method of the calculation model is used may be appropriately selected according to the type of sheet of paper P to be determined, the wavelength of light irradiated by the light radiation unit 21 of the transmitted-light measuring unit 20, the configuration of the conveyance path of the copying machine 1A, or the like. In the calculation model in the present embodiment, a database of spectra indicating moisture contents of various values is created respectively for a variety of types of the sheet of paper P, and the calculation model is derived by a canonical discriminant analysis method based on the database that has been created. The calculation model may be stored in the storage unit 41 beforehand.

Next, by applying the calculation model that has been read to the calculated absorbance Ata, the type determination unit 43A calculates a predicted value as an index that indicates whether the sheet of paper P can be regarded as being the same as an already measured paper type, as well as uncertainty of the predicted value. The predicted value denotes an index indicating a characteristic of the type of sheet of paper P.

Next, the type determination unit 43A reads out the determination model from the storage unit 41, and determines the type of sheet of paper P in accordance with the determination model that has been read and the predicted value and uncertainty that have been calculated. Here, a determination model will be described. The determination model may be a model for determining the type of sheet of paper P by using the calculated index (in the present embodiment, the above-described predicted value and uncertainty).

FIG. 9 is a diagram illustrating an example of a determination model according to the present embodiment. In the present embodiment, the type determination unit 43A uses determination models MA1 to MA6. As illustrated in FIG. 2, the determination models MA1 to MA6 may include predicted values and uncertainty for each type of sheet of paper P (No. 1 to No 5 in FIG. 9). For example, the type determination unit 43A utilizes the determination models MA1 to MA6 to, for example, (1) determine a paper type of a in a case where the predicted value calculated from the calculation model is 0.5 or greater and the uncertainty is less than 0.5, (2) determine a paper type of β in a case where the predicted value calculated from the calculation model is less than 0.5 and the uncertainty is less than 0.5, and (2)

determine and attach a message for attracting attention to the confidence in a case where the uncertainty is 0.5 or greater.

A specific example of a method for determining the type of sheet of paper P by the type determination unit 43A according to the present embodiment will be described with reference to FIG. 10. FIG. 10 is a flowchart illustrating an example of a flow of a process of determining the type of sheet of paper P by the type determination unit 43A.

Figure 10:
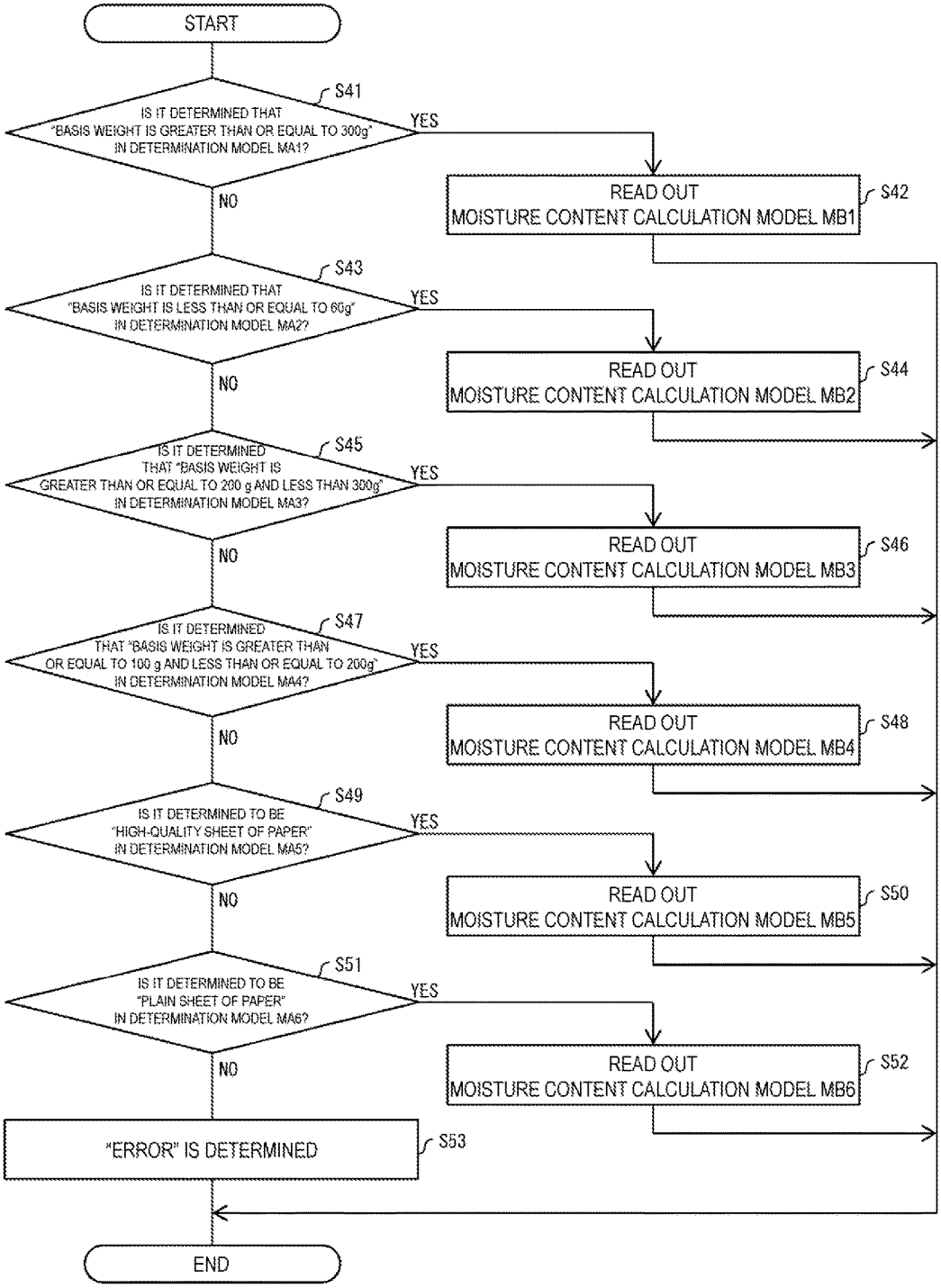
FIG. 10 is a flowchart illustrating an example of a flow of a process of determining a type of sheet of paper by a type determination unit provided in the copying machine.

As illustrated in FIG. 10, the type determination unit 43A first reads out, from the storage unit 41, the determination model MA1, which serves as a model for determining whether the basis weight of the sheet of paper is 300 g or greater. Next, using the determination model MA1 and the predicted value and uncertainty that have been calculated, the type determination unit 43A determines whether the basis weight of the sheet of paper P is 300 g or greater (S41). In a case where it is determined that the basis weight of the sheet of paper P is 300 g or greater (YES in S41), the type determination unit 43A reads out a moisture content calculation model MB1 (to be described later in detail) for a case where the basis weight of the sheet of paper P is 300 g or greater (S42).

In contrast, in a case where it is determined that the basis weight of the sheet of paper P is not 300 g or greater (NO in S41), the type determination unit 43A reads out, from the storage unit 41, a determination model MA2, which serves as a model for determining whether the basis weight of the sheet of paper is less than 60 g. Next, using the determination model MA2 and the predicted value and uncertainty that have been calculated, the type determination unit 43A determines whether the basis weight of the sheet of paper P is less than 60 g (S43). In a case where it is determined that the basis weight of the sheet of paper P is less than 60 g (YES in S43), the type determination unit 43A reads out a moisture content calculation model MB2 (to be described later in detail) for a case where the basis weight of the sheet of paper P is less than 60 g (S44).

Hereinafter, similarly, the type determination unit 43A uses a determination model MA3, which serves as a model for determining whether the basis weight of the sheet of paper is 200 g or more and less than 300 g (S45, S46), a determination model MA4, which serves as a model for determining whether the basis weight of the sheet of paper is 100 g or greater and less than 200 g (S47, S48), a determination model MA5, which serves as a model for determining whether the sheet of paper is of high quality (S49, S50), and a determination model MA6, which serves as a model for determining whether the sheet of paper is a plain one (S51, S52), and the type determination unit 43A performs processing similar to the processes in Step S41 and Step S42. In this way, the type determination unit 43A reads out the moisture content calculation models MB3 to MB6 (which will be described in detail later), respectively, corresponding to the type of sheet of paper P in each step.

Note that in a case where it is determined that the sheet of paper P is not a plain sheet of paper (NO in S51), the type determination unit 43A determines that the sheet of paper P is not classified into any paper type; that is, an error (S53).

As described above, in the present embodiment, the type determination unit 43A sequentially determines the types of sheet of paper sequentially from the basis weight that is extremely large or extremely small. For example, a sheet of paper having a basis weight of 300 g or more is thick, and a sheet of paper having a basis weight of 60 g or less is extremely thin, and thus it is easy to distinguish from other paper type characteristics and determination is easy. In contrast, it is difficult to determine a high-quality sheet of paper and a plain sheet of paper because of similar basis weights. Therefore, after removing the possibility of another paper type, whether the high-quality sheet or the plain sheet is determined. That is, by sequentially using one of the determination models MA1 to MA6 for each stage, the type of sheet of paper P is determined with high accuracy.

In addition, the type determination unit 43A determines the type of sheet of paper P based on the intensity of the light (received-light intensity Vta) transmitted through the sheet of paper P that has been measured by the transmitted-light measuring unit 20 and the intensity of the light (reference received-light intensity Vt0*a*) that has not passed through the sheet of paper P. This eliminates the influence of errors such as a fluctuation in amount of light emitted from the light radiation unit 21, a sensitivity of the light-receiving unit 22, or an amplification factor of an amplification circuit that amplifies an output from the light-receiving unit 22, and thus enables the type determination unit 43A to determine the type of sheet of paper P with high accuracy.

Figure 11:
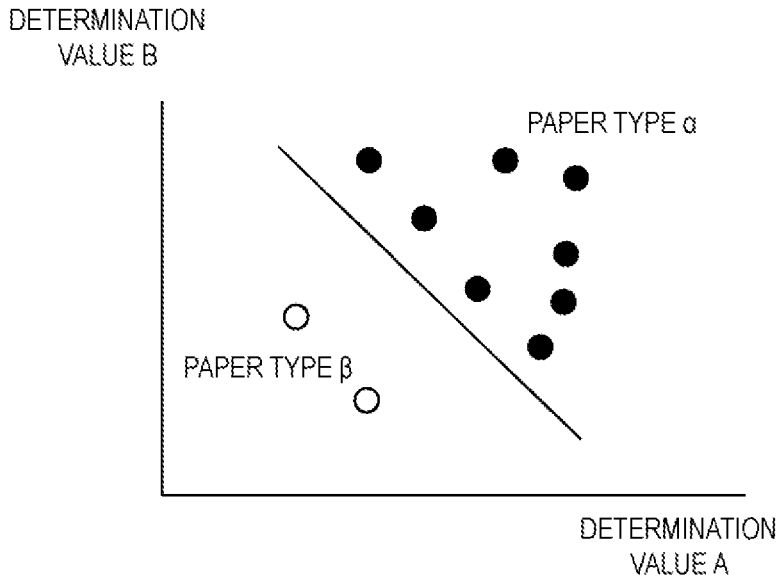
FIG. 11 is a graph of a determination model in a modification of a method for determining the paper type according to the first embodiment.

Here, the method for determining the type of sheet of paper P in a modification will be described with reference to FIG. 11. FIG. 11 is a graph of a determination model in a modification of the method for determining the type of sheet of paper P according to the present embodiment. In the present modification, the type determination unit 43A calculates a plurality of indices (a determination value A and a determination value B), and plots on a graph points determined by the plurality of indices that have been calculated (the determination value A and the determination value B). The determination value A and the determination value B, for example, can be applied with numerical values expressing, as a distance, the similarity or the degree of separation between the measured data and the data already stored in the storage unit. The type determination unit 43A determines a paper type of a in a case of being higher than a predetermined reference straight line, as plotted with black circles in FIG. 11, and determines a paper type of β in a case of being lower than the reference straight line, as plotted with white circles in FIG. 11. Note that, although a two-dimensional plot is performed in FIG. 11, a three-dimensional plot may be performed using three indices (for example, the determination value A, the determination value B, and a determination value C), and may be determined based on whether the points defined by a plurality of indices (the determination value A and the determination value B) are plotted in an area that has been confirmed beforehand that a particular type of sheet of paper is to be plotted. In addition, although two paper types are determined in the above description, three or more paper types are determined by setting three or more levels and determining which level the plotted point corresponds to. Whether the type of sheet of paper P is determined only by numerical values using one index as illustrated in FIG. 9 or is determined from the graph with a plurality of indices as illustrated in FIG. 11 may be determined as appropriate depending on the paper type that is assumed to be handled by the image forming apparatus and how strictly the user intends to determine the paper type. In addition, the reference value in FIG. 9 or the reference straight line in FIG. 11 may be suitably determined in a similar fashion.

Calculation of Moisture Content of Sheet of Paper P

Next, a method for calculating the moisture content of the sheet of paper P by the moisture content calculation unit 44A (Step S18 in FIG. 6) will be described with reference to FIG. 11.

First, the moisture content calculation unit 44A calculates a reference received-light intensity Vr0*a*, which serves as a received-light intensity in a state where there is no sheet of paper P present between the light radiation unit 31 and the light-receiving unit 32. To be specific, the moisture content calculation unit 44A reads from the storage unit 41 the electric signal value Vrsa1 and the electric signal value Vrna1 measured in Step S12, calculates the reference received-light intensity Vr0*a* using Expression 4 below, and outputs the reference received-light intensity Vr0*a* that has been calculated, to the storage unit 41.

$$Vr0a=Vrsa1-Vrna1 \quad (4).$$

Next, the moisture content calculation unit 44A calculates the received-light intensity Vra, which serves as a received-light intensity in a state where the sheet of paper P is present between the light radiation unit 31 and the light-receiving unit 32. To be specific, the moisture content calculation unit 44A reads the electric signal value Vrsa2 and the electric signal value Vrna2 measured in Step S17 from the storage unit 41, calculates the received-light intensity Vra using Expression 5 below, and outputs the reference received-light intensity Vr0*a* that has been calculated, to the storage unit 41.

$$Vra=Vrsa2-Vrna2 \quad (5).$$

Note that in the present embodiment, as described above, as measurements are made at two places on the sheet of paper P in step S17, the moisture content calculation unit 44A outputs an average value of the received-light intensities at the above two locations, to the storage unit 41, as the received-light intensity Vra.

Next, the moisture content calculation unit 44A calculates an absorbance Ara of the sheet of paper P. To be specific, the moisture content calculation unit 44A reads the reference received-light intensity Vr0*a* and the received-light intensity Vra from the storage unit 41, and applies the Lambert-Beer rule to the received-light intensity Vra as indicated in Expression 6 below to calculate the absorbance Ata of the sheet of paper P.

$$Ara=\log(Vr0a/Vra) \quad (6).$$

Here, the light irradiated on the sheet of paper P from the light radiation unit 31 is reflected by the sheet of paper P after passing through or scattering while being absorbed by moisture contained in the sheet of paper P inside a thin layer on the surface of the sheet of paper P. Accordingly, the light reflected by the sheet of paper P may include information regarding the amount of water (moisture content) contained in the surface of the sheet of paper P. Put differently, the calculated absorbance Ara of the sheet of paper P may include information regarding the amount of water (moisture content) contained in the surface of the sheet of paper P.

Next, the moisture content calculation unit 44A calculates the moisture content of the surface of the sheet of paper P by substituting the absorbance Ara, which has been calculated, into the moisture content calculation model calculated by a regression analysis and stored in the storage unit 41 beforehand. Such a regression analysis can be a method for statistically obtaining beforehand a relational expression between the absorbance for a predetermined light wavelength and the moisture content of a sheet of paper. To be specific, the moisture content calculation unit 44A calculates the moisture content of the surface of the sheet of paper P by substituting the absorbance Ara into Expression (7) below.

$$\text{Moisture Content}=A\times Ara+D \quad (7).$$

Here, the coefficient A and the coefficient D serve as coefficients determined by conditions such as the wavelength of the light irradiated by the light radiation unit 31, the type of sheet of paper P, and an internal configuration of the copying machine 1A, and the coefficients corresponding to various conditions are obtained by the regression analysis and stored in the storage unit 41 beforehand. Note that, as the absorbance of the surface of the sheet of paper P is proportional to the moisture content of the sheet of paper P, the moisture content on the surface of the sheet of paper P can be calculated by a simple linear equation (primary equation) as in the Expression (7) above. This enables the moisture content calculation unit 44A to calculate the moisture content of the surface of the sheet of paper P with high accuracy.

The moisture content calculation unit 44A calculates the moisture content of the sheet of paper P by using any of the moisture content calculation models MB1 to MB6 (that is, the coefficient A and the coefficient D corresponding to the type of sheet of paper P determined by the type determination unit 43A) corresponding to the type of sheet of paper P determined by the type determination unit 43A in step 15.

As described above, in the copying machine 1A, the moisture content calculation unit 44A calculates the moisture content of the surface of the sheet of paper P based on the type of sheet of paper P determined by the type determination unit 43A and the absorbance Ara calculated from the light intensity measured by the reflected-light measuring unit 30. This enables the moisture content calculation unit 44A to calculate the moisture content of the surface of the sheet of paper P with high accuracy. Note that the moisture content can also be calculated using the transmittance or the reflectance of the sheet of paper P, but the transmittance and reflectance are not proportional to the moisture content of the paper surface. Hence, calculation of the moisture content of the paper surface using the transmittance or the reflectance of the sheet of paper P becomes complicated in comparison with calculation of the moisture content of the paper surface using an absorbance, and calculation of the moisture content takes more time.

In addition, the moisture content calculation unit 44A calculates the moisture content of the sheet of paper P based on the intensity of the light reflected by the sheet of paper P (received-light intensity Vra), which is measured by the reflected-light measuring unit 30 and the intensity of the light reflected by the standard reflective plate 6 (reference received-light intensity Vr0*a*). This eliminates the influence of errors such as a fluctuation in amount of light emitted from the light radiation unit 31, the sensitivity of the light-receiving unit 32, or the amplification factor of the amplification circuit that amplifies the output from the light-receiving unit 32, such that the moisture content calculation unit 44A calculates the moisture content of the sheet of paper P with high accuracy.

In addition, in the copying machine 1A according to the present embodiment, the moisture content calculation unit 44A calculates the moisture content of the surface of the sheet of paper P by using the moisture content calculation model that has been obtained using the regression analysis. That is, the moisture content of the surface of the sheet of paper P may be calculated using a calculation formula that has been statistically obtained beforehand. In this way, in comparison with the known calculation method for calculating the moisture content of the surface of the sheet of paper P by simply matching the reflectance or absorbance with the moisture content, the moisture content of the surface of the sheet of paper P is calculated with accuracy. In the known calculation method, it is not unusual for errors of 5% or more to occur in moisture content values, but in the copying machine 1A of the present embodiment, for example, as illustrated in FIG. 12 to be described later, the moisture content on the surface of the sheet of paper P in increments of 1% or 0.5% is calculated. In this way, transfer conditions and fixing conditions for the sheet of paper P are set in a more suitable manner.

The moisture content calculation model may vary depending on the type of sheet of paper P due to differences in the thickness of the sheet of paper P, differences in the surface smoothness of the sheet of paper P, or the like. Therefore, in the present embodiment, it is possible to automatically select a moisture content calculation model corresponding to the type of sheet of paper P determined from the measurement result by the transmitted-light measuring unit 20, and calculate the moisture content of the surface of the sheet of paper P with high accuracy. This prevents setting errors in the moisture content of the surface of the sheet of paper P, as a result of a user forgetting or incorrectly setting the paper type.

Setting of Image Forming Condition

Next, a method for setting the image forming conditions by the image forming condition setting unit 45 (Step S19 in FIG. 6) will be described with reference to FIG. 12. FIG. 12 is a diagram illustrating a relational database used by an image forming condition setting unit 45 for setting image forming conditions.

In the setting of the image forming conditions by the image forming condition setting unit 45, first, the image forming condition setting unit 45 reads out the relational database depicted in FIG. 12 from the storage unit 41. Next, in addition to the printing conditions decided by the user and the temperature measured by the environment measuring unit 8, the image forming condition setting unit 45 uses the relational database that has been read to set the image forming conditions based on the type of sheet of paper P determined by the type determination unit 43A and the moisture content of the surface of the sheet of paper P calculated by the moisture content calculation unit 44A.

More particularly, the image forming conditions are preset for each predetermined range of the type of sheet of paper P determined by the type determination unit 43A and for each predetermined range of the moisture content of the surface of the sheet of paper P calculated by the water content calculation unit 44A, and the image forming condition setting unit 45 sets the image forming conditions based on the preset image forming conditions, the type of sheet of paper P, and the moisture content of the first side of the sheet of paper P. For example, as illustrated in FIG. 12, the moisture content of the surface of the first side of the sheet of paper P can be set at a range of 1%, and when it is intended to divide the conditions granularly, the moisture content of the first side of the sheet of paper P can be set at a narrower range, such as 0.5% increments. Alternatively, a range that is not less than a particular threshold value, such as "15% or more" may also be set. These range settings may be configured as necessary according to the specification of the image forming apparatus, and the climate of the area where the image forming apparatus is used.

Note that, in the image forming apparatus according to one embodiment, the image forming condition setting unit 45 may set at least one value for the voltage applied to the transfer device 15, the current supplied to the transfer device 15, the pressure at which the pressure roller 16*a* pressurizes the sheet of paper P, the current for driving the heat source (halogen lamp), and the conveyance speed of the sheet of paper P at the time of the fixing. The configured transfer conditions and fixing conditions may be output to the transfer device 15 and the fixing unit 16, respectively, by the image forming condition setting unit 45.

In the present embodiment, the image forming conditions for the first and second sides are set based on the same relational database, but the image forming apparatus in the present embodiment is not limited thereto. That is, the image forming apparatus in one embodiment may set the image forming conditions for the first side and the image forming conditions for the second side, based on separately configured relational databases or corresponding tables.

Substantial Characteristics of Copying Machine 1A

As described above, the copying machine 1A includes a type determination unit 43A for determining the type of sheet of paper P based on the intensity of the light measured by the transmitted-light measuring unit 20, a moisture content calculation unit 44A for calculating the moisture content of the sheet of paper P based on the type of sheet of paper P determined by the type determination unit 43A and the intensity of the light measured by the reflected-light measuring unit 30, and an image forming condition setting unit 45 for setting an image forming condition based on the type of sheet of paper P determined by the type determination unit 43A and the moisture content of the sheet of paper P calculated by the moisture content calculation unit 44A.

According to the above configuration, the type determination unit 43A can determine the type of sheet of paper P with high accuracy, based on the intensity of the light measured by the transmitted-light measuring unit 20. Then, the moisture content calculation unit 44A can calculate the moisture content of the sheet of paper P with high accuracy, based on the type of determined sheet of paper P and the light intensity measured by the reflected-light measuring unit 30. As a result, the image forming condition setting unit 45 can set a suitable image forming condition, based on the accurately determined type of sheet of paper P and the accurately calculated moisture content of the sheet of paper P.

Usually, the measurement of light intensity of the transmitted light greatly depends on the thickness of the sheet of paper P, and is suitable for determining the type of sheet of paper, but in contrast, is not suitable for measuring the moisture content of the sheet of paper. Conversely, as the measurement of light intensity of the reflected light contains relatively large information regarding the surface of the sheet of paper P, it is suitable for measuring the moisture content of the sheet of paper. However, in contrast, it has a lower accuracy in the determination of the type of sheet of paper and may not be suitable.

Accordingly, the copying machine 1A having the configuration described above leverages the merits of both the measurement by using transmitted light and the measurement by using reflected light, and thus supplements disadvantages with each other. That is, by using the measurement of the intensity of the transmitted light with which information regarding the type of sheet of paper P is easily obtainable, the determination of the type of sheet of paper P is enabled. In contrast, by using the measurement of the intensity of the reflected light with which information regarding the moisture content on the surface of the sheet of paper P is easily obtainable, the determination of the moisture content on both sides of the sheet of paper P is enabled. As a result, with respect to printing on the first side and printing on the second side, in consideration of the type of sheet of paper P and the moisture content of the surface of the first side or the second side of the sheet of paper P, the transfer conditions and the fixing conditions can be suitably set. Accordingly, regardless of the type of sheet of paper P and the moisture content of the surface of the sheet of paper P, the image quality of the image transferred to the first side and the image quality of the image transferred to the second side can be made uniform.

Note that, in the above description of the printing operation, an operation for performing double-sided printing on a sheet of sheet of paper P has been described, but the copying machine 1A in the present embodiment is not limited to such an operation. The printing process can be performed a plurality of times on the same side of the sheet of sheet of paper P.

In addition, in the present embodiment, the copying machine 1A has been described as an image forming apparatus, but the image forming apparatus in the present embodiment is not limited to such a copying machine. The image forming apparatus may include, for instance, a commercial printing machine, a printer, a facsimile machine, and the like, provided it uses a form of printing performed under conditions with varying moisture content, such as heating for a fixing process. In a case where the image forming apparatus is a commercial printing machine, a printer, or a facsimile machine, the image forming apparatus may perform a process of receiving the image data as data, instead of the process of reading an original document (Step S4 in FIG. 5).

In addition, in the copying machine 1A according to the present embodiment, the moisture content of the surfaces of both sides, including the first side and the second side of the sheet of paper P, are calculated using the reflected-light measuring unit 30. As a result, in comparison to cases in which individual reflected-light measuring units are provided in order to calculate the moisture content of each of the first side and the second side of the sheet of paper P, the copying machine 1A achieves reductions in space and cost.

In addition, the copying machine 1A in the present embodiment may be configured to have one photosensitive drum. However, the image forming apparatus in the present embodiment is not limited thereto. The image forming apparatus in one embodiment may be an image forming apparatus capable of performing color printing on the sheet of paper P.

In the case that the image forming apparatus in one embodiment is capable of performing color printing, there are single-drum types in which each color toner image is carried in one photosensitive drum, and multi-drum types in which a plurality of photosensitive drums can carry different color toner images. With either type, when printing is performed with a step that involves heating the sheet of paper P, as the moisture content of the sheet of paper P differs before and after the process, the same problem as in the present embodiment may arise. Accordingly, even in the case of color printing, the printing is properly performed by adjusting the image forming conditions according to the moisture content, like the copying machine 1A in the present embodiment.

Modification 1

Figure 13:
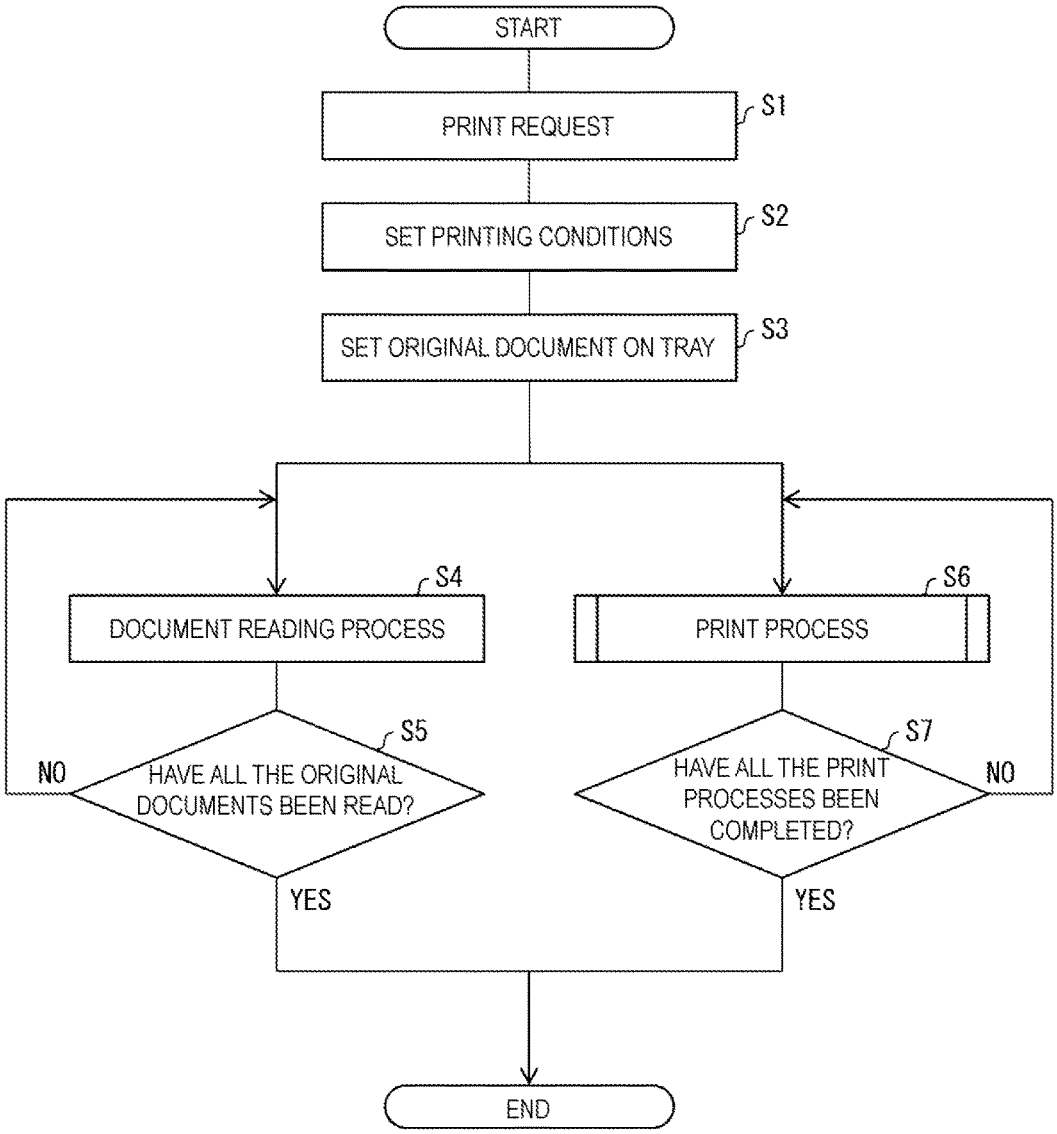
FIG. 13 is a flowchart illustrating an example of a flow of a process of performing double-sided printing on a sheet of paper using a copying machine that is a modification of the above-mentioned copying machine.

Next, a modification of the copying machine 1A according to the first embodiment will be described with reference to FIG. 13. FIG. 13 is a flowchart illustrating an example of a flow of a process of performing double-sided printing on the sheet of paper P using a copying machine that is a modification of the copying machine 1A of the first embodiment.

In the copying machine 1A according to the above embodiment, as illustrated in FIG. 13, the printing process (Step S6) is initiated after all original document reading is completed in Step S5. Usually, for copying machines (multifunction peripherals), however, higher printing speed is extremely highly demanding, and in order to shorten even one second, the printing process is to start without waiting for completion of reading an original document.

Therefore, as illustrated in FIG. 13, the copying machine according to the present modification performs the processing of reading an original document (S4) and printing processing (S6) in parallel. For example, measurement of the reference data may be initiated while reading a first original document in parallel, for instance. In this way, when image data of a plurality of original documents is printed on a plurality of sheets of sheet of paper P, the printing process can be performed in a short time.

Modification 2

Next, further modifications of the copying machine 1A according to the first embodiment will be described with reference to FIG. 14A, to FIG. 15B.

The copying machine 1A according to the present modification includes a transmitted-light measuring unit (measuring unit) 20A and a reflected-light measuring unit 30A in place of the transmitted-light measuring unit 20 and the reflected-light measuring unit 30 of the first embodiment.

Figure 14A:
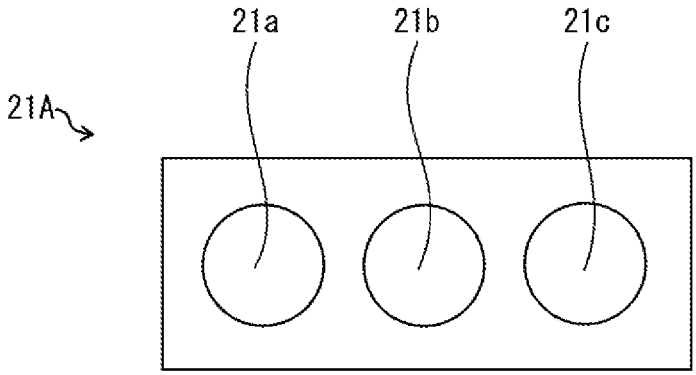
FIG. 14A is a plan view illustrating a configuration of a light radiation unit of a transmitted-light measuring unit provided in a copying machine as another modification of the copying machine.
Figure 14B:
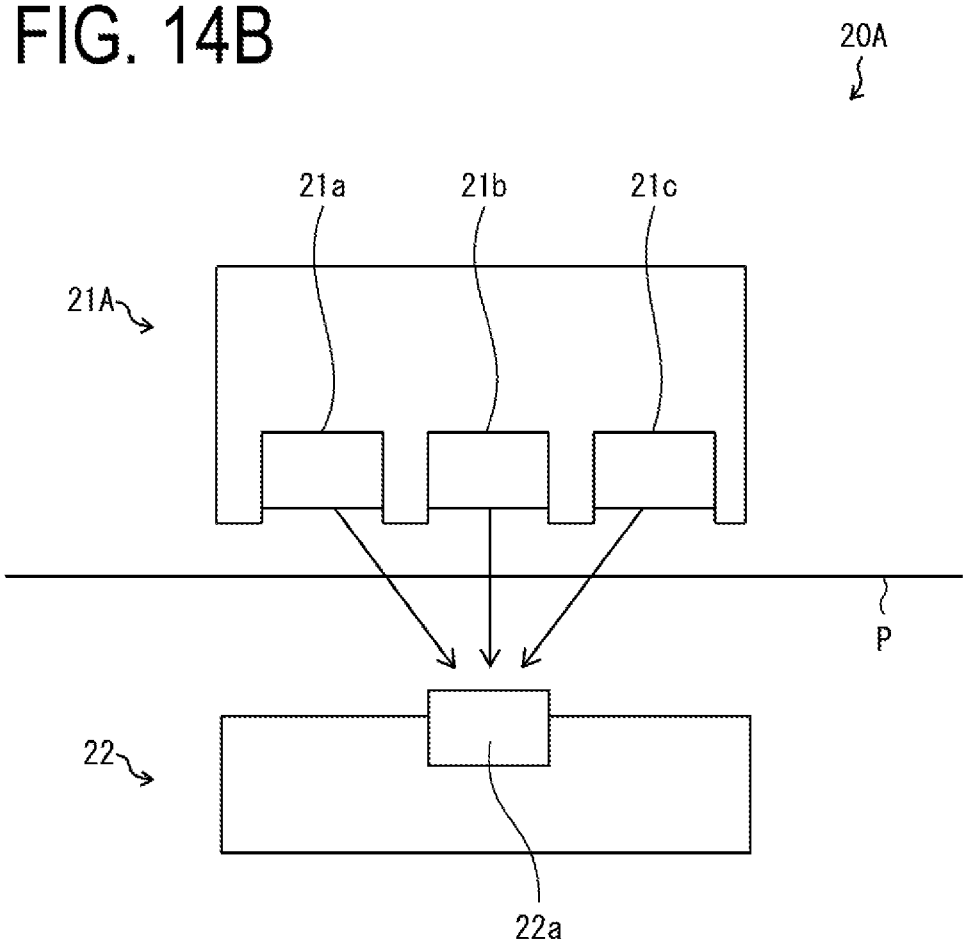
FIG. 14B is a diagram illustrating a positional relationship between a light radiation unit and a light-receiving unit of the transmitted-light measuring unit and a sheet of paper.

FIG. 14A illustrates the configuration of the light radiation unit 21A of the transmitted-light measuring unit 20A, and FIG. 14B illustrates the positional relationship between the light radiation unit 21A and the light-receiving unit 22 of the transmitted-light measuring unit 20A and the sheet of paper P. As illustrated in FIG. 14B, the transmitted-light measuring unit 20A includes a light radiation unit 21A, in place of the light radiation unit 21 in the first embodiment.

As illustrated in FIG. 14A and FIG. 14B, the light radiation unit 21A includes light sources 21*a*, 21*b*, and 21*c*, each including one semiconductor light emitting element. The light sources 21*a*, 21*b*, and 21*c* irradiate (emit) the sheet of paper P with three types of light having different wavelengths. The light sources 21*a*, 21*b*, and 21*c* irradiate light having peak wavelengths of λ21*a*, λ21*b*, and λ21*c*, respectively. In the present modification, the light source 21*a*, 21*b*, and 21*c* are arranged in a row, but the present modification is not limited to this arrangement. The arrangement of the light sources 21*a*, 21*b*, and 21*c* may be any arrangement so long as the light-receiving unit 22 can receive the light that has been irradiated from the light sources 21*a*, 21*b*, and 21*c* and then transmitted through the sheet of paper P. The wavelength of the light irradiated by each of the light sources 21*a*, 21*b*, and 21*c* may be greater than or equal to 800 nm and less than or equal to 1100 nm.

Note that, in the present modification, although LEDs are provided as the light sources 21*a*, 21*b*, and 21*c* of the light radiation unit 21, the image forming apparatus in the present modification is not limited to this configuration. The light source of the irradiation unit in one embodiment may be any light source so long as it can irradiate light of a wavelength capable of determining the type of sheet of paper P and calculating the moisture content of the surface of the sheet of paper P. Examples of the light source may include a halogen lamp and a phosphor. In the case of a light source having a wavelength range for light emission, such as halogen lamps or phosphors, the light may include a plurality of wavelengths. Accordingly, in the image forming apparatus in one embodiment, for example, by providing a wavelength filter that allows light having different wavelengths to be transmitted from the light radiation unit, the light radiation unit may be configured to irradiate the sheet of paper P with three types of light having different wavelengths.

Note that the number of light sources of the light radiation unit 21A, the wavelength/intensity of light irradiated by the light source, and the like may be appropriately selected according to the configuration of the copying machine 1A and the type of sheet of paper P to be measured. Also, it should be noted that in the determination of the type of sheet of paper P, to improve the determination accuracy, at least two wavelengths of light can be irradiated by the light radiation unit 21A.

Figure 15A:
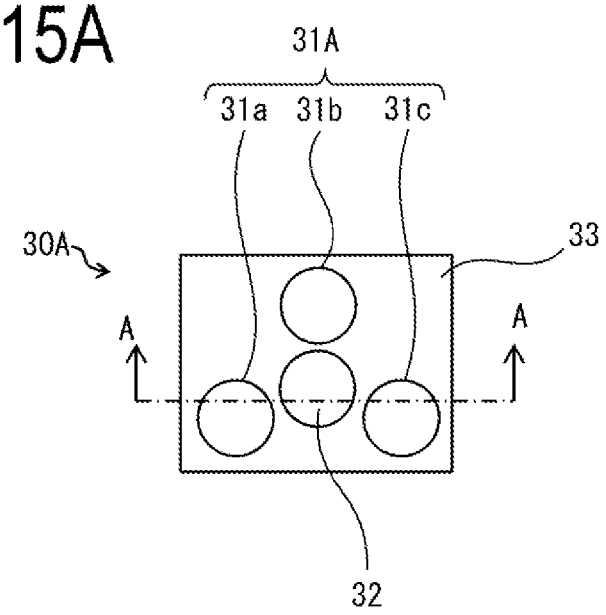
FIG. 15A is a plan view illustrating a configuration of a reflected-light measuring unit provided in a copying machine.
Figure 15B:
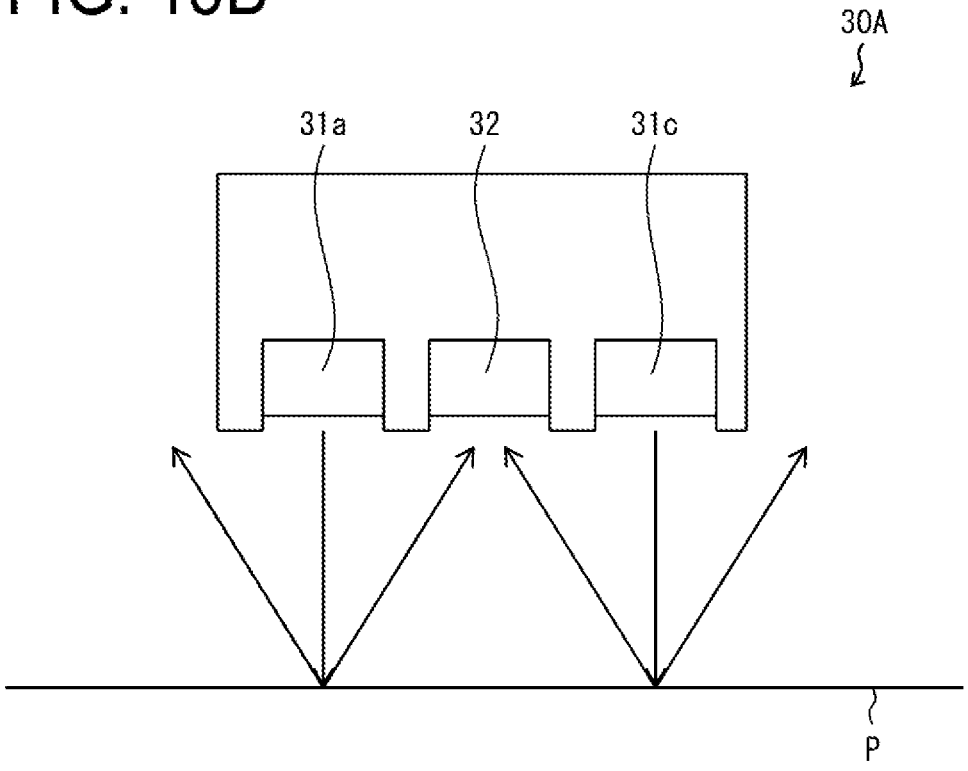
FIG. 15B illustrates a positional relationship between the light radiation unit and the light-receiving unit of the reflected-light measuring unit and a sheet of paper, and is a cross-sectional view taken along the line A-A in FIG. 15A.

FIG. 15A is a plan view illustrating a configuration of a reflected-light measuring unit 30A, and FIG. 15B illustrates a positional relationship between the light radiation unit 31A and the light-receiving unit 32 of the reflected-light measuring unit 30A and a sheet of paper P, and is a cross-sectional view taken along the line A-A in FIG. 15A. As illustrated in FIG. 15A and FIG. 15B, the reflected-light measuring unit 30A includes a light radiation unit 21A, in place of the light radiation unit 31 in the first embodiment.

As illustrated in FIG. 15A and FIG. 15B, the light radiation unit 31A includes the light sources 31*a*, 31*b*, and 31*c*, each including a semiconductor light emitting element. The light sources 31*a*, 31*b*, and 31*c* irradiate (emit) a sheet of paper P with three types of light having different wavelengths. The configurations of the light sources 31*a*, 31*b*, and 31*c* are similar to the configurations of the light sources 21*a*, 21*b*, and 21*c*, their descriptions will be omitted herein. In the present modification, although the light sources 31*a*, 31*b*, and 31*c* are provided in a housing 33 surrounding the light-receiving unit 32, the present modification is not limited to such an arrangement. That is, the arrangement of the light sources 31*a*, 31*b*, and 31*c* is not particularly limited so long as the light-receiving unit 32 can receive the light that has been irradiated from the light sources 31*a*, 31*b*, and 31*c* and then reflected by the sheet of paper P.

Next, a measurement of light intensity by the transmitted-light measuring unit 20A will be described. Here, a measurement corresponding to Step S11 of FIG. 6 will be described. Note that a measurement of light intensity by the reflected-light measuring unit 30A is also the same.

In the measurement of the reference data by the transmitted-light measuring unit 20A, first, the Steps S31 to S36 in FIG. 7 are performed on the light source 21*a*. In this way, the transmitted-light measuring unit 20A directly receives the light that has been irradiated from the light source 21*a* with the light-receiving unit 22, and outputs an electric signal value Vtsa1 having a magnitude corresponding to the intensity of the received light and an electric signal value Vtna1 having a magnitude corresponding to the intensity of the background light, to the storage unit 41.

Next, with respect to the light source 21*b*, Steps S31 to S36 of FIG. 7 are performed. In this way, the transmitted-light measuring unit 20A receives the light that has been irradiated from the light source 21*b* with the light-receiving unit 22, and outputs an electrical signal value Vtsb1 having a magnitude corresponding to the intensity of the received light and an electric signal value Vtnb1 having a magnitude corresponding to the intensity of the background light, to the storage unit 41.

Next, with respect to the light source 21*c*, Steps S31 to S36 of FIG. 7 are performed. In this way, the transmitted-light measuring unit 20A receives the light that has been irradiated from the light source 21*c* with the light-receiving unit 22, and outputs an electrical signal value Vtsc1 having a magnitude corresponding to the intensity of the received light and an electric signal value Vtnc1 having a magnitude corresponding to the intensity of the background light, to the storage unit 41.

Next, a method for determining the type of sheet of paper P (Step S15 in FIG. 6) by the type determination unit 43A in the present modification will be described.

In the present modification, the type determination unit 43A first calculates the absorbances Ata, Atb, and Atc, respectively, for each of the light sources 21*a*, 21*b*, and 21*c* by using the electrical signal values measured by the transmitted-light measuring unit 20A in Step S11 and Step S14 of FIG. 6. The method for calculating the absorbances Ata, Atb, and Atc are the same as the method for calculating the absorbance Ata in the first embodiment, and thus the description will be omitted herein.

Next, using the absorbances Ata, Atb, and Atc, which have been calculated, the type determination unit 43A calculates indices indicating characteristics of the type of sheet of paper P. In the first embodiment, the type determination unit 43A calculates an index indicating a characteristic of the type of sheet of paper P by using one absorbance Ata. In contrast, in the present modification, the type determination unit 43A calculates indices indicating characteristics of the type of sheet of paper P by using a plurality of absorbances (the three absorbances Ata, Atb, and Atc in the present modification). In this way, the type determination unit 43A is capable of calculating the indices with high accuracy. As a result, the type determination unit 43A is capable of determining the type of sheet of paper P more accurately by applying the indices that have been calculated with high accuracy to the determination model.

Next, a method for determining the type of sheet of paper P by the moisture content calculation unit 44A (Step S18 in FIG. 6) in the present embodiment will be described.

In the present modification, the moisture content calculation unit 44A first calculates the absorbances Ara, Arb, and Arc, respectively, for each of the light sources 31*a*, 31*b*, and 31*c* by using the electric signal values measured by the reflected-light measuring unit 30A in Step S12 and Step S17 of FIG. 6. The method for calculating the absorbances Ara, Arb, and Arc are the same as the method for calculating the absorbance Ara in the first embodiment, and thus the description will be omitted herein.

Next, the moisture content calculation unit 44A calculates the moisture content of the surface of the sheet of paper P by substituting the calculated absorbances Ara, Arb, and Arc into a moisture content calculation model, which has been calculated by a multiple regression analysis and stored in the storage unit 41 beforehand. To be specific, the moisture content calculation unit 44A calculates the moisture content of the surface of the sheet of paper P by substituting the absorbances Ara, Arb, and Arc into Expression (8) below.

$$\text{Moisture content}=A\times Ara+B\times Arb+C\times Arc+D \quad (8).$$

Here, the coefficients A, B, C, and D serve as coefficients determined by conditions such as the wavelength of the light irradiated by the light radiation unit 31*a*, the type of sheet of paper P, and the internal configuration of the copying machine 1A, and the coefficients corresponding to various conditions, and are obtained by the multiple regression analysis and stored in the storage unit 41 beforehand.

In the first embodiment, the moisture content calculation unit 44A calculates the moisture content of the surface of the sheet of paper P by using one absorbance Ara. In contrast, in the present modification, the moisture content calculation unit 44A calculates the moisture content of the surface of the sheet of paper P by using a plurality of absorbances (three absorbances Ara, Arb, and Arc in the present modification). This enables the moisture content calculation unit 44A to calculate the moisture content of the surface of the sheet of paper P with high accuracy.

Note that in the copying machine 1A according to the present modification, although the multiple regression analysis is used as a calculation model when calculating the moisture content of the surface of the sheet of paper P, the image forming apparatus in the present modification is not limited thereto. That is, although the calculation model in the image forming apparatus in one embodiment can be a multivariate analysis technique capable of calculating the moisture content of the surface of the sheet of paper P by using the absorbances calculated for each wavelength of mutually different lights irradiated by the light radiation unit 21, other calculation models may also be used. For example, the moisture content on the surface of the sheet of paper P may be calculated by using another calculation model such as a Partial Linear Square (PLS) regression analysis or the like, as the calculation model.

Second Embodiment

Another embodiment of the present disclosure will be described with reference to FIG. 16 and FIG. 17. It is noted that for convenience of description, components illustrated in the above-described embodiments are designated by the same reference numerals as those having the same function, and descriptions will be omitted as appropriate.

Figure 16:
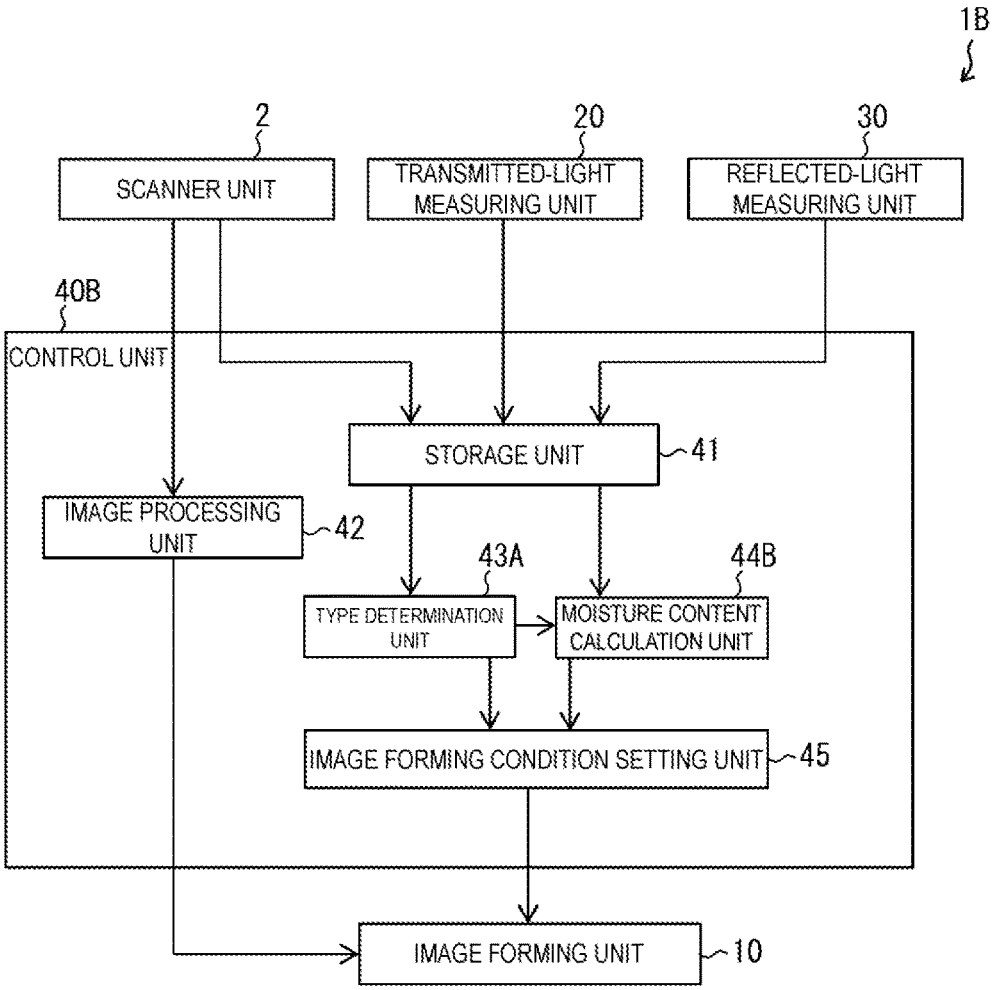
FIG. 16 is a block diagram illustrating a configuration of substantial components of a copying machine according to a second embodiment.
Figure 17:
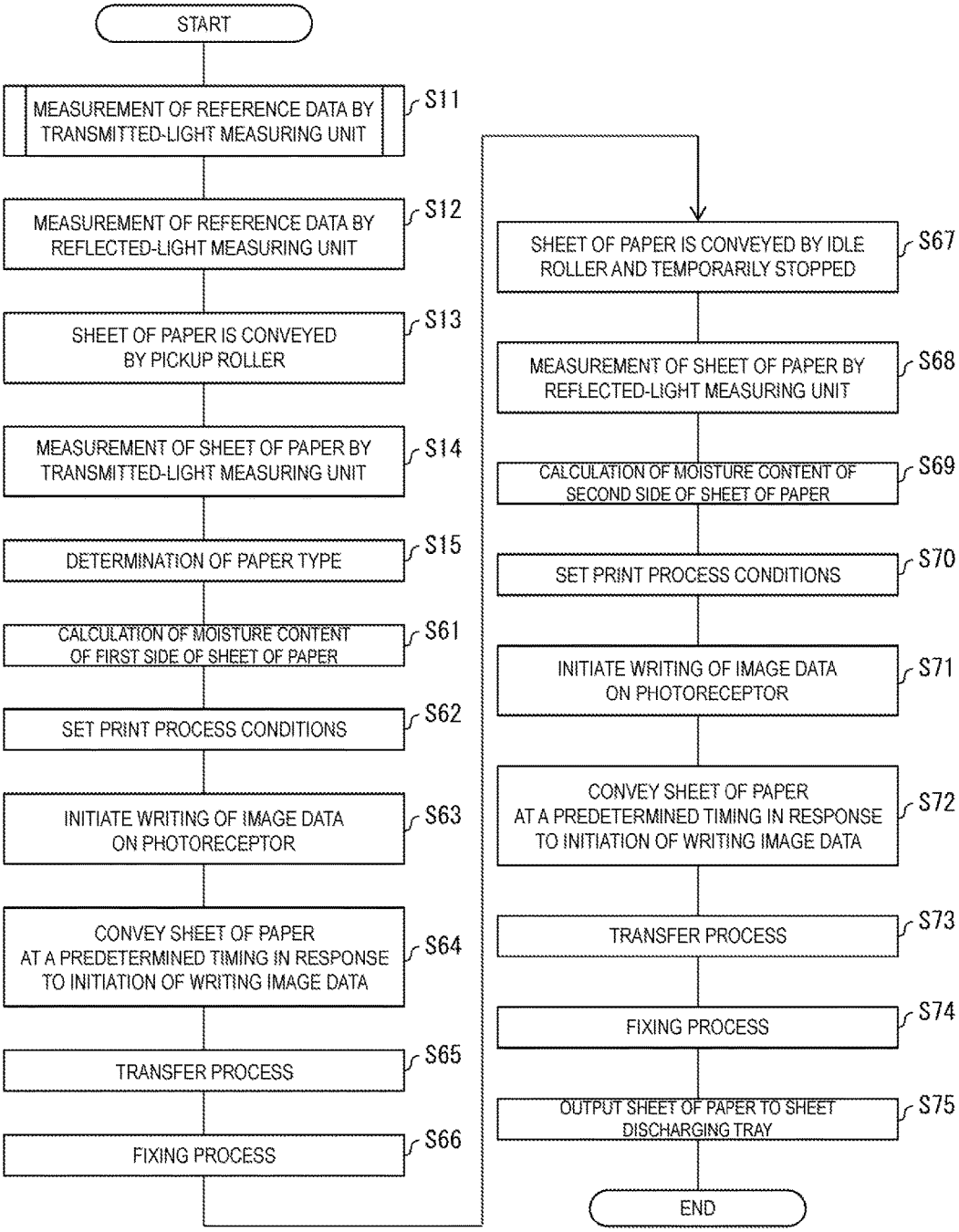
FIG. 17 is a flowchart illustrating an example of a flow of a printing process in the above-described copying machine.

FIG. 16 is a block diagram illustrating a configuration of substantial components of a copying machine 1B according to the present embodiment.

As illustrated in FIG. 16, the copying machine 1B includes a control unit 40B, in place of the control unit 40A of the copying machine 1A in the first embodiment. The control unit 40B includes a moisture content calculation unit 44B, in place of the moisture content calculation unit 44A in the first embodiment.

In the copying machine 1A in the first embodiment, when the moisture content calculation unit 44A calculates the moisture content of the surface of the first side of the sheet of paper P, the moisture content calculation unit 44A is configured to calculate the moisture content by using the light intensity that has been measured by the reflected-light measuring unit 30. In contrast, in the copying machine 1B, the moisture content calculation unit 44B is configured to calculate the moisture content of the surface of the first side of the sheet of paper P by using the light intensity that has been measured by the transmitted-light measuring unit 20.

In the present embodiment, as only the printing process (S6) in the printing operation depicted in FIG. 5 in the first embodiment is different, only the printing process will be described here.

The printing process in the copying machine 1B will be described with reference to FIG. 17. FIG. 17 is a flowchart illustrating an example of a flow of a printing process in the copying machine 1B.

In the printing process in the copying machine 1B, first, the Steps S11 to S15 described in the first embodiment are performed.

Next, the moisture content calculation unit 44B calculates the moisture content of the surface of the first side of the sheet of paper P (S61). To be specific, the moisture content calculation unit 44B calculates the moisture content of the surface of the sheet of paper P by substituting the absorbance Ata, which has been calculated using the light intensity measured by the transmitted-light measuring unit 20 in Step S11 and Step S14, into the moisture content calculation model that has been calculated by regression analysis and stored in the storage unit 41 beforehand. Note that in Step S61, the moisture content calculation unit 44B calculates the moisture content of the sheet of paper P by using the absorbance Ata calculated using the light intensity that has been measured by the transmitted-light measuring unit 20. Accordingly, the calculated moisture content is not the moisture content on the surface of the sheet of paper P, but an average value of the moisture content on the light path, through which the light irradiated by the transmitted-light measuring unit 20 passes, in the sheet of sheet of paper P. That is, the calculated moisture content is the average value of the moisture contents on the first side and the second side of the sheet of paper P. The transmitted-light measuring unit 20 cannot measure only the moisture content on the first side of the sheet of paper P, and thus in this embodiment, the moisture content on the first surface of the sheet of paper P is approximately substituted by the average value of the moisture content on the light path, through which the light irradiated by the transmitted-light measuring unit 20 passes, in the sheet of paper P.

Next, according to the type of sheet of paper P that has been determined by the type determination unit 43A and the moisture content on the surface of the first side of the sheet of paper P that has been calculated by the moisture content calculation unit 44B, the image forming condition setting unit 45 sets an image forming condition for the first side of the sheet of paper P (S62).

Next, the image forming unit 10 performs printing on the first side of the sheet of paper P (S63 to S66). Steps S63 to S66 are the same as S21 to S23 in the first embodiment, the description will be omitted herein.

Next, the control unit 40B performs a printing process on the second side of the sheet of paper P (S67 to S74). Steps S63 to S66 are the same as S16 to S23 in the first embodiment, the description will be omitted herein.

Finally, the sheet of paper P passes through the sheet discharging roller 7, and is ejected to the sheet discharging tray (S75). Thus, the printing process (S6) on one sheet of paper P by the copying machine 1A is completed.

As described above, in the copying machine 1B, the type of sheet of paper P and the moisture content on the surface of the sheet of paper P are calculated based on the intensity of the light that has been measured by the transmitted-light measuring unit 20 in the printing process to the first side, from the printing processes to the first side and the second side of the sheet of paper P. That is, the printing process to the first side eliminates the need for the measurement of the intensity of the light by the reflected-light measuring unit 30.

According to the above configuration, the setting of the printing process to the first side is performed quickly. As a result, the time between is an image forming process request and the image forming process is shortened.

Third Embodiment

Yet another embodiment will be described with reference to FIG. 18 and FIG. 19.

Figure 18:
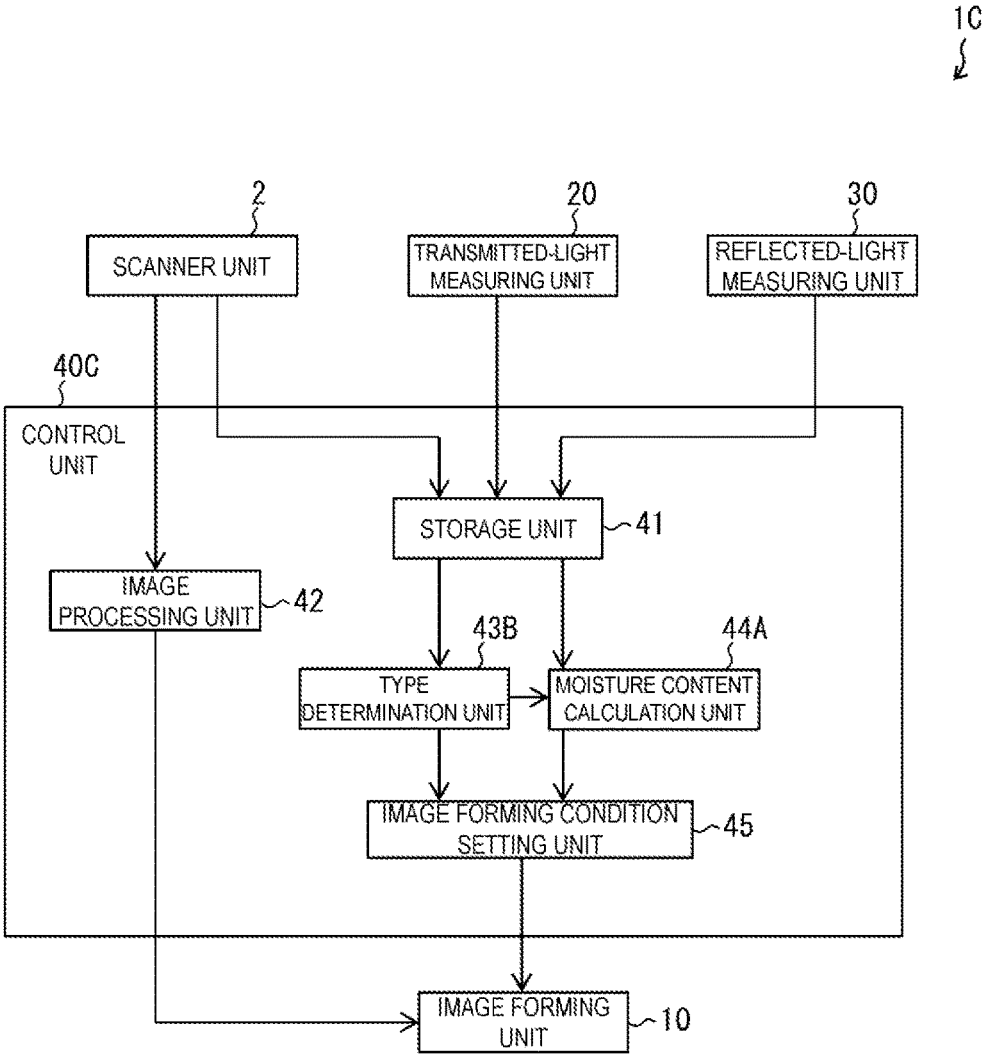
FIG. 18 is a block diagram illustrating a configuration of substantial components of a copying machine according to a third embodiment.

FIG. 18 is a block diagram illustrating a configuration of substantial components of a copying machine according to the present embodiment.

As illustrated in FIG. 16, the copying machine 1C includes a control unit 40C, in place of the control unit 40A in the first embodiment. The control unit 40C includes a type determination unit 43B, in place of the type determination unit 43A in the first embodiment.

In the copying machine 1C in the present embodiment, the type determination unit 43B determines the type of sheet of paper P in advance before a print request is issued by a user. To be specific, when a user opens or closes the paper cassette 3, the type determination unit 43B determines the type of sheet of paper P.

The process of determining the type of sheet of paper P in the copying machine 1C in the present embodiment will be described with reference to FIG. 19. FIG. 19 is a flowchart illustrating an example of a flow of the process for determining the type of sheet of paper P in the copying machine 1C.

Figure 19:
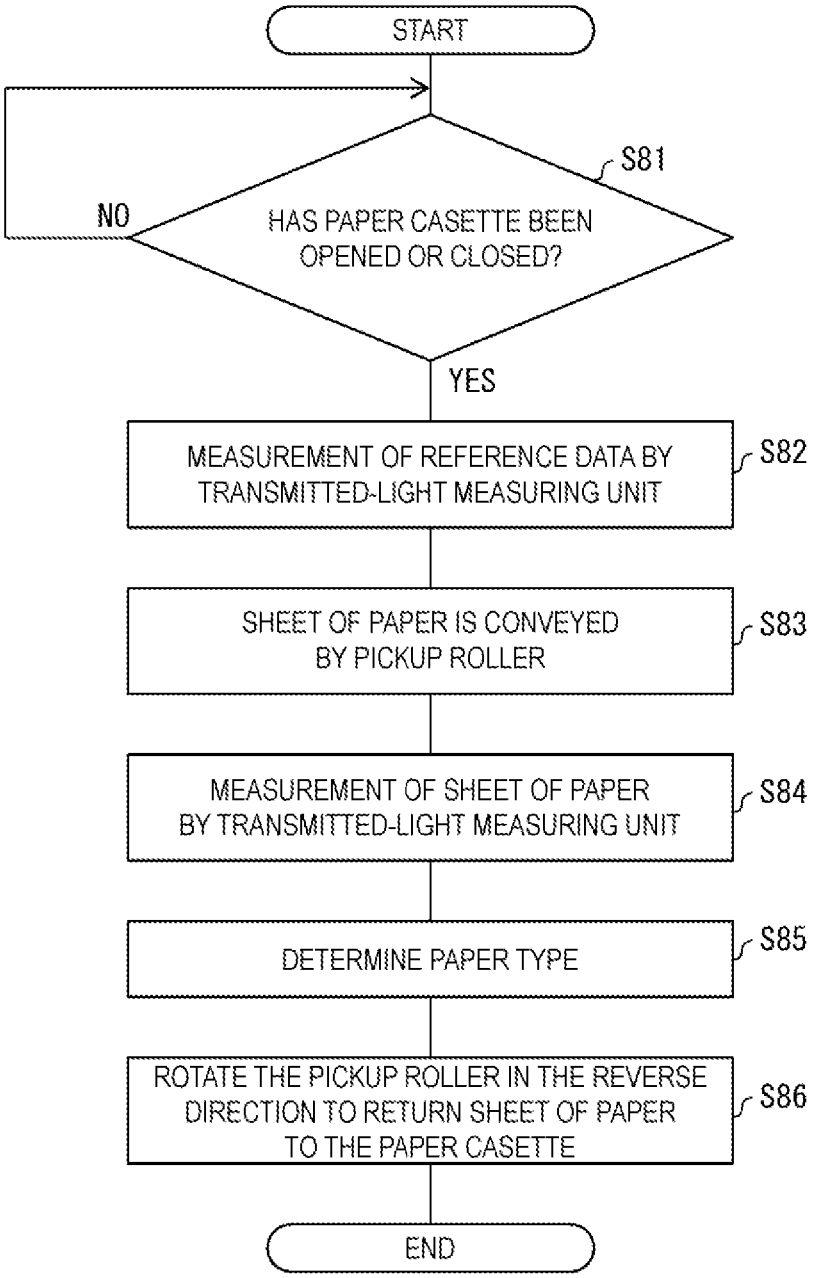
FIG. 19 is a flowchart illustrating an example of a flow of a sheet of paper type determination process in the copying machine.

As illustrated in FIG. 19, first, the control unit 40C determines whether the paper cassette has been opened or closed by the user (S81).

Next, when the paper cassette 3 is opened or closed by the user (YES in S81), the transmitted-light measuring unit 20 measures reference data (S82). Step S82 may be the same as Step S11 in FIG. 6.

Next, the pickup roller 4 takes out a sheet of paper P contained in the paper cassette 3, conveys the sheet to the primary conveyance path R1, and holds the sheet of paper P on the primary conveyance path R1 (S83).

Next, the transmitted-light measuring unit 20 measures such a sheet of paper P idle on the primary conveyance path R1 (S84). Step S84 may be the same as Step S14 in FIG. 6.

Next, the type determination unit 43B may determine the type of sheet of paper P based on the intensity of the light measured by the transmitted-light measuring unit 20 (that is, measured in Step S82 and Step S84) (S85). Step S85 may be the same as Step S15 in FIG. 6. The type determination unit 43B outputs the determined type of sheet of paper P to the storage unit 41. The type of sheet of paper P stored in the storage unit 41 may be held until the next time the paper cassette 3 is opened or closed.

Lastly, the pickup roller 4 is rotated in reverse, and the measured sheet of paper P is returned to the paper cassette 3 (S86).

Next, the printing process in the copying machine 1C will be described. In the printing process in the copying machine 1C, Steps S1, S14, and S15 out of the steps depicted in FIG. 6 are omitted, whereas the other steps are the same. In the present embodiment, the type of sheet of paper P may have already been determined in Step S86 and stored in the storage unit 41.

As described above, in the copying machine 1C according to the present embodiment, the type determination unit 43B determines the type of sheet of paper P in advance before a print request is issued by a user. In this way, the measurement by the transmitted-light measuring unit 20 can be performed before a print request from the user is received. This shortens the time between the image forming process request and the image forming process.

Note that, in the present embodiment, although only one paper cassette 3 is provided, a plurality of paper feed cassettes can be provided, and the type of sheet of paper P for each paper cassette may be stored in the storage unit 41. In this case, a plurality of transmitted-light measuring units 20 may be provided for each paper cassette, or one transmitted-light measuring unit 20 may be provided on a common conveyance path, through which the sheets of paper P fed from a plurality of paper cassettes pass. In addition, by displaying information regarding the type of sheet of paper P stored in the storage unit 41 on an operation panel or enabling the information for reference via a network, a user may be informed of the type of sheet of paper P contained in each paper cassette. This enables the user to confirm the type of sheet of paper P before printing, and prevents a mistake of printing on a wrong type of sheet of paper P.

In addition, in the copying machine 1C, each time the paper cassette 3 is opened or closed, the transmitted-light measuring unit 20 measures and the type determination unit 43B determines the type of sheet of paper P. In this way, the type of sheet of paper P is always stored in the storage unit 41.

In addition, in the present embodiment, the type of sheet of paper P is determined when the sheet of paper cassette 3 is opened or closed, but in the image forming apparatus in one embodiment, the type of a next sheet of paper P may be determined in preparation for the next print request each time a printing process for one print request is completed. Further, in the image forming apparatus in one embodiment, the type of sheet of paper P may be determined every time a predetermined number of sheets are printed, or every fixed period such as every day.

Fourth Embodiment

Figure 20:
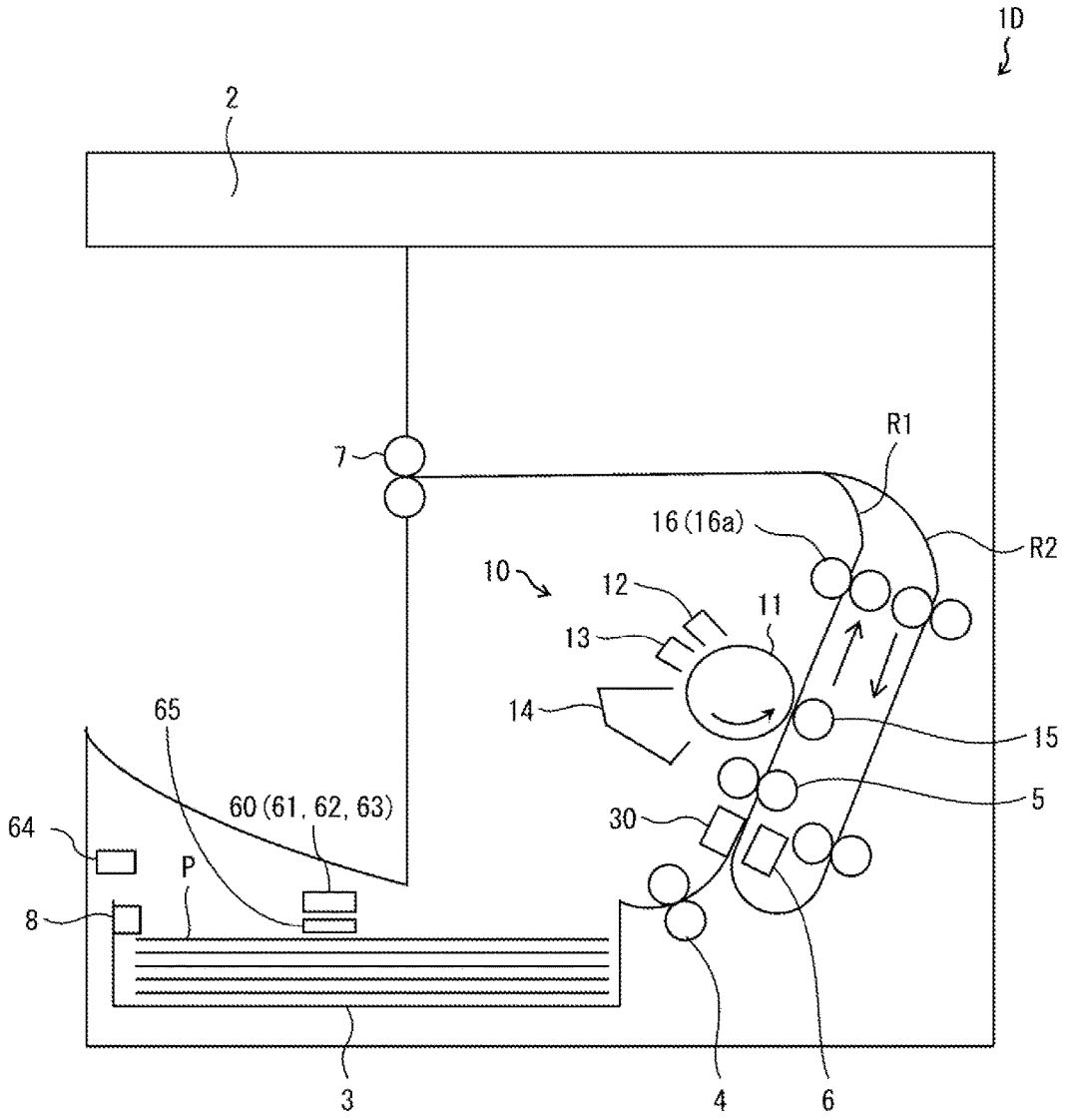
FIG. 20 is a schematic diagram illustrating the structure of a copying machine according to a fourth embodiment.
Figure 21:
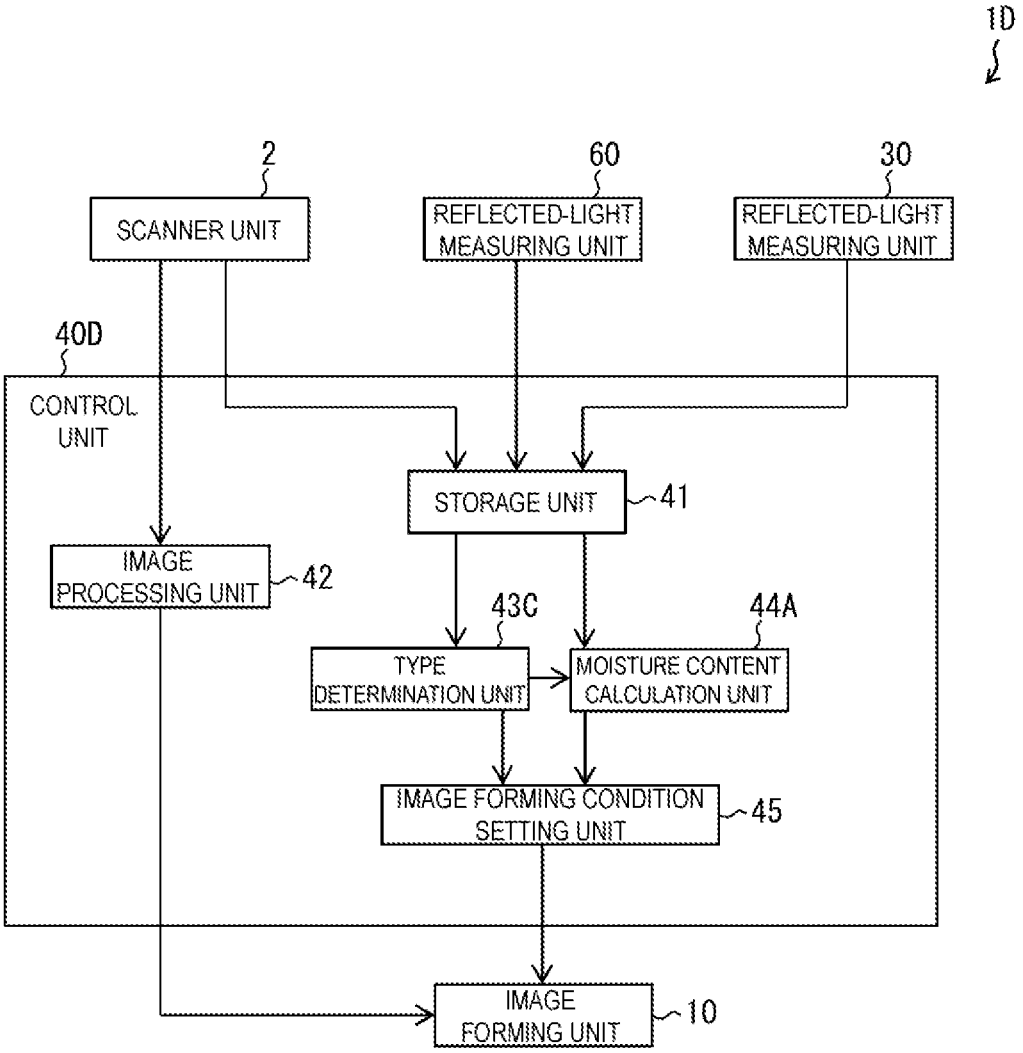
FIG. 21 is a block diagram illustrating a configuration of substantial components of the copying machine.
Figure 22:
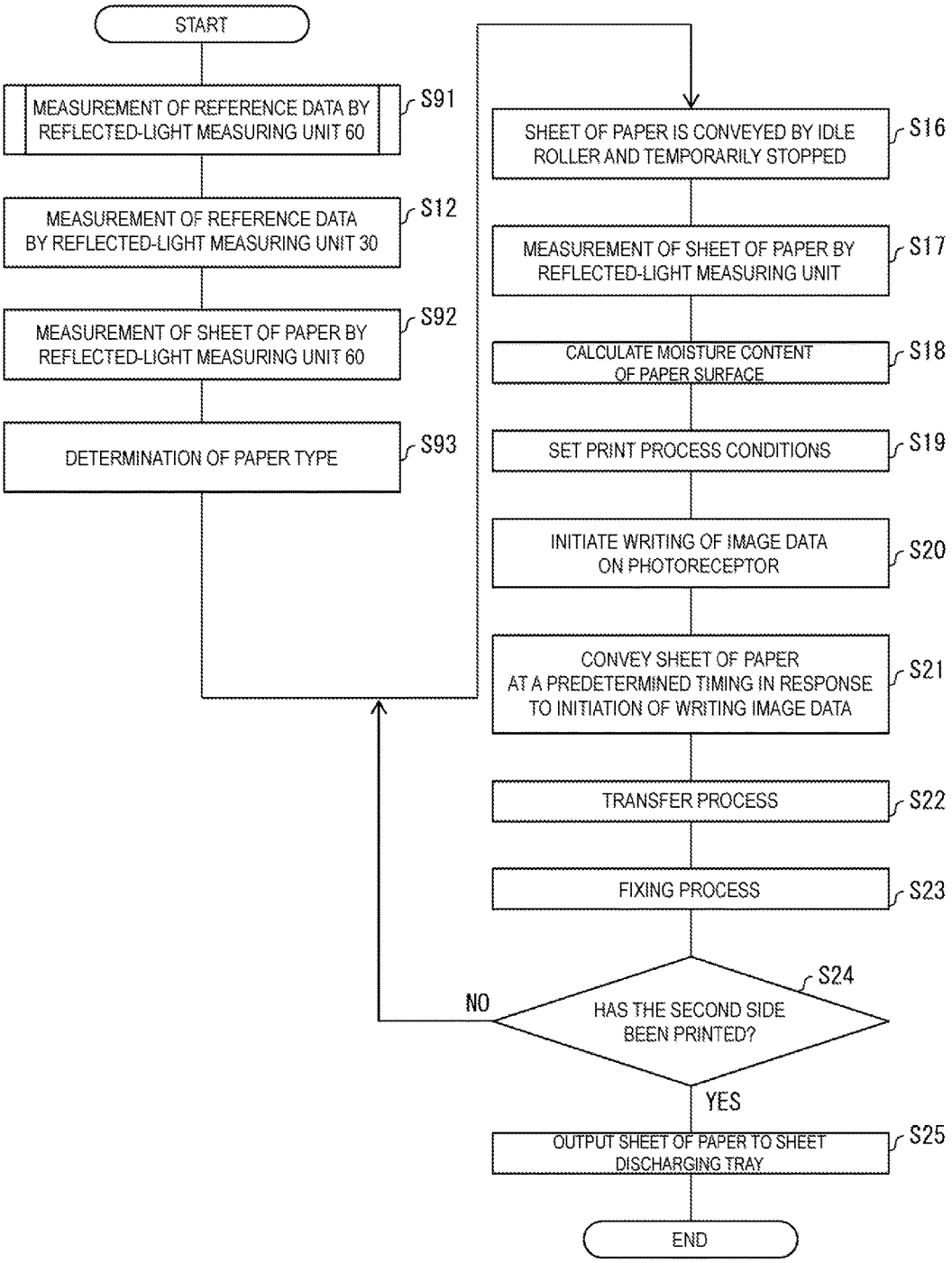
FIG. 22 is a flowchart illustrating an example of a flow of a printing process in the copying machine.

Further another embodiment will be described with reference to FIG. 20 to FIG. 22.

The configuration of a copying machine 1D according to the present embodiment will be described with reference to FIG. 20 and FIG. 21. FIG. 20 is a schematic diagram illustrating a structure of the copying machine 1D. FIG. 21 is a block diagram illustrating a configuration of substantial components of the copying machine 1D.

The copying machine 1D includes a reflected-light measuring unit 60 (measuring unit, first measuring unit) and a control unit 40D, in place of the transmitted-light measuring unit 20 and the control unit 40A of the copying machine 1A in the first embodiment. Also, in addition to the configuration of the copying machine 1A, the copying machine 1D further includes a driving unit 64 and a standard reflective plate 65.

The reflected-light measuring unit 60 is configured to irradiate light on the sheet of paper P contained in the paper cassette 3, and to measure the intensity of the light reflected by the surface of the sheet of paper P. The reflected-light measuring unit 60 includes a light radiation unit 61, a light-receiving unit 62, and a housing 63. The configurations of the light radiation unit 61, the light-receiving unit 62, and the housing 63 may be the same as those of the light radiation unit 31, the light-receiving unit 32, and the housing 33 of the reflected-light measuring unit 30, respectively.

The driving unit 64 is configured to move the reflected-light measuring unit 60. In more detail, the driving unit 64 moves the reflected-light measuring unit 60 to a side surface of the paper cassette 3 while the reflected-light measuring unit 60 is not measuring the intensity of the light reflected by the surface of the sheet of paper P contained in the paper cassette 3, and moves the reflected-light measuring unit 60 above the paper cassette 3 (that is, above the sheet of paper P contained in the paper cassette 3) when the reflected-light measuring unit 60 measures the intensity of the light.

The standard reflective plate 65 serves as a reflective plate for reflecting the light irradiated from the light radiation unit 61 of the reflected-light measuring unit 60 to the light-receiving unit 62, and is provided on the same side surface with the reflected-light measuring unit 60, in the paper cassette 3. However, the location where the standard reflective plate is provided is not limited to this. The location where the standard reflective plate is provided may be any location so long as the light-receiving unit 62 can receive the light irradiated from the light radiation unit 61 and then reflected by the standard reflective plate without obstruction. The standard reflective plate 65 may be formed of the same material as the standard reflective plate 6 in the first embodiment.

The control unit 40D includes a type determination unit 43C, in place of the type determination unit 43A in the first embodiment. In the copying machine 1D in the present embodiment, the type determination unit 43C determines the type of sheet of paper P based on the light intensity that has been measured by the reflected-light measuring unit 60.

In the present embodiment, as only the printing process (S6) in the printing operation depicted in FIG. 5 in the first embodiment is different, only the printing process will be described here.

The printing process in the copying machine 1D will be described with reference to FIG. 22. FIG. 22 is a flowchart illustrating an example of a flow of a printing process in the copying machine 1D.

In the printing process to the sheet of paper P by the copying machine 1D, first, the reflected-light measuring unit 60 measures the reference data used for calculating the moisture content of the surface of the sheet of paper P by using the standard reflective plate 65 (S91). Note that before starting the printing process, the reflected-light measuring unit 60 is moved by the driving unit 64 to a side surface of the paper cassette 3. The reflected-light measuring unit 60 irradiates the standard reflective plate 65 arranged on the side surface of the paper cassette 3 with light using the light radiation unit 61, and receives the light reflected by the surface of the standard reflective plate 65 with the light-receiving unit 62. Next, the reflected-light measuring unit 60 measures the intensity of the received light, and outputs a measurement result to the storage unit 41. It should be noted that, with the exception that the standard reflective plate 65 is used, the measurement by the reflected-light measuring unit 60 is the same as Step S12 in the first embodiment.

Next, the reflected-light measuring unit 30 measures the reference data (S12). It should be noted that Step S91 and Step S12 are performed at the same time.

Next, the reflected-light measuring unit 60 measures the sheet of paper P (S92). To be specific, first, the driving unit 64 moves the reflected-light measuring unit 60 above the paper cassette 3 (that is, above the sheet of paper P contained in the paper cassette 3). Next, the light radiation unit 61 of the reflected-light measuring unit 60 irradiates the sheet of paper P contained in the paper cassette 3 with light, and the light-receiving unit 52 receives the light reflected by the sheet of paper P. It should be noted that the reflected-light measuring unit 60 measures the light intensities at several places of the sheet of paper P. To be specific, the measurement for the first location may be performed in a state in which the sheet of paper P is stored in the paper cassette 3, and measurements for the second and subsequent locations may be performed in a state in which the sheet of paper P is pulled out by a predetermined distance from the paper cassette 3 by the pickup roller 4 after conveyance has been initiated. In this way, the determination accuracy of the type of sheet of paper P is improved by measuring different locations of the sheet of paper P.

Next, the type determination unit 43C determines the type of sheet of paper P based on the intensity of the light that has been measured by the reflected-light measuring unit 60 (that is, measured in Step S91 and Step S92) (S93). Step S93 may be the same as Step S15 in FIG. 6.

The subsequent operations are the same as Step S16 and subsequent steps described in the first embodiment, and thus the description will be omitted herein.

According to the above configuration, the type of sheet of paper P is determined in the situation where the sheet of paper P is stored in the paper cassette 3. In this way, as the image forming conditions can be set quickly, the time between the image forming process request and the image forming process is shortened.

Example Enabled by Software

Control blocks (in particular, the control units 40A to 40D) of the copying machines 1A to 1D may be achieved by logic circuits (hardware) formed in an integrated circuit (IC chip) or the like, or may be achieved by software using a Central Processing Unit (CPU).

In using the CPU, the copying machines 1A to 1D each include a CPU for executing instructions of a program serving as software for implementing each function, Read Only Memory (ROM) or a storage device (also referred to as a "recording medium") in which the above program and various types of data are recorded to be readable by a computer (or CPU), Random Access Memory (RAM) in which the above program is developed, and the like. Then, when the computer (or CPU) reads the program from the recording medium and executes the program, an object of the present disclosure is achieved. As the above recording medium, a "non-temporarily tangible medium," for example, a tape, a disk, a card, a semiconductor memory, a programmable logic circuit, and the like may be used. Further, the above program may be supplied to the above computer via any transmission medium (such as communication networks, or broadcast waves) capable of transmitting the program. It should be noted that one embodiment may be achieved in the form of a data signal embodied by electronically transmitting the above program, where the data signal is embedded in a carrier wave.

An image forming apparatus (copying machines 1A to 1D) according to a first aspect of the present invention includes: a measuring unit (transmitted-light measuring unit 20, 20A, reflected-light measuring unit 30, 60) that includes at least one light source (21*a*, 21*b*, 21*c*, 31*a*, 31*b*, 31*c*), and is configured to irradiate light emitted by the light source onto a sheet of paper (P), to receive light transmitted through the sheet of paper or reflected by the sheet of paper, and to measure an intensity of the received light; a type determination unit (43A, 43B, 43C) configured to determine a type of the sheet of paper, based on the intensity of the light measured by the measuring unit; a moisture content calculation unit (44A, 44B) configured to calculate a moisture content of the sheet of paper, based on the type of the sheet of paper determined by the type determination unit and the intensity of the light measured by the measuring unit; and a setting unit (image forming condition setting unit 45) configured to set an image forming condition for the sheet of paper, based on the type of the sheet of paper determined by the type determination unit and the moisture content of the sheet of paper calculated by the moisture content calculation unit.

According to the above configuration, the type determination unit determines the type of sheet of paper with high accuracy, based on the intensity of the light measured by the measuring unit. The moisture content calculation unit calculates the moisture content of the sheet of paper with high accuracy, based on the type of the sheet of paper determined by the type determination unit and the intensity of the light measured by the measuring unit. As a result, the setting unit appropriately controls the image forming condition for the sheet of paper. That is, the type of the sheet of paper and the moisture content are determined with high accuracy, and thus the image forming condition is controlled, accordingly.

The image forming apparatus according to a second aspect of the present invention, in the abode-described first aspect, may be configured such that the measuring unit includes a reflected-light measuring unit (30, 60) configured to receive the light reflected by the sheet of paper and measure the intensity of the received light; and the moisture content calculation unit is configured to calculate the moisture content of the sheet of paper, based on the intensity of the light measured by the reflected-light measuring unit.

According to the above configuration, the measurement of light intensity of the reflected light includes relatively substantial information regarding the surface of the sheet of paper. Accordingly, the moisture content calculation unit calculates the moisture content of the sheet of paper, based on the intensity of the light measured by the reflected-light measuring unit, and thus the moisture content calculation unit can calculate the moisture content of the sheet of paper with high accuracy.

The image forming apparatus according to a third aspect of the present invention, in the above-described first or second aspect, may be configured such that the measuring unit includes a transmitted-light measuring unit (20, 20A) configured to receive the light transmitted through the sheet of paper and measure the intensity of the received light; and the type determination unit is configured to determine the type of the sheet of paper, based on the intensity of the light measured by the transmitted-light unit.

According to the above configuration, the intensity of the light transmitted through the sheet of paper may be substantially influenced by the thickness of the sheet of paper. Accordingly, the type determination unit determines the type of the sheet of paper based on the intensity of the light measured by the transmitted-light measuring unit, and thus the type determination unit determines the paper type with high accuracy.

The image forming apparatus according to a fourth aspect of the present invention, in any one of the above-described first to third aspects, may be configured to include a paper feed cassette (3) configured to contain the sheet of paper; a take-out roller (pickup roller 4) for taking out sheet of paper from the paper feed cassette; and a holding roller (idle roller 5) configured to temporarily hold the sheet of paper on a conveyance path before a transfer process is performed on the sheet of paper. The measuring unit includes a first measuring unit (transmitted-light measuring unit 20) and a second measuring unit (reflected-light measuring unit 30). The first measuring unit is configured to measure the sheet of paper taken out from the paper feed cassette by the take-out roller and temporarily held by the take-out roller, the second measuring unit is configured to measure the sheet of paper held by the holding roller, the type determination unit is configured to determine the type of the sheet of paper based on the intensity of the light measured by the first measuring unit, and the moisture content calculation unit is configured to calculate the moisture content of the sheet of paper based on the intensity of the light measured by the second measuring unit.

According to the above configuration, according to the intensity of the light measured by the first measuring unit, the type determination unit determines the type of the sheet of paper with high accuracy. Then, according to the type of the determined sheet of paper and the intensity of the light measured by the second measuring unit, the moisture content calculation unit calculates the moisture content of the sheet of paper with high accuracy. As a result, the setting unit sets a suitable image forming condition based on accurately determined type of the sheet of paper and the accurately calculated moisture content of the sheet of paper.

The image forming apparatus according to a fifth aspect of the present invention, in the above-described fourth aspect, may be configured such that the first measuring unit measures the sheet of paper before an image formation request is issued by a user.

According to the above configuration, the first measuring unit measures the sheet of paper before the image forming request is issued by the user. Thus, the type of the sheet of paper is determined beforehand. As a result, the time between is an image forming process request and the image forming process is shortened.

The image forming apparatus according to a sixth aspect of the present invention, in the above-described fifth aspect, may be configured such that the first measuring unit measures the sheet of paper whenever the paper feed cassette is opened or closed.

According to the above configuration, the type of sheet of paper is always stored in the image forming apparatus.

The image forming apparatus according to a seventh aspect of the present invention, in the above-described first or second aspect, may further include a paper feed cassette configured to contain the sheet of paper; and a holding roller configured to temporarily hold the sheet of paper on a conveyance path before a transfer process is performed on the sheet of paper. The measuring unit includes a first measuring unit (reflected-light measuring unit 60) and a second measuring unit (reflected-light measuring unit 30). The first measuring unit is configured to irradiate the light on the sheet of paper contained in the paper feed cassette, to receive reflected light, and to measure the intensity of the received light. The second measuring unit is configured to perform measurement on the paper held by the holding roller. The type determination unit is configured to determine the type of the sheet of paper, based on the intensity of the light measured by the first measuring unit. The moisture content calculation unit is configured to calculate the moisture content of the sheet of paper, based on the intensity of the light measured by the second measuring unit.

According to the above configuration, determine the type of sheet of paper is determined in a situation where the sheet of paper is contained in the paper cassette. In this way, as the image forming conditions can be set quickly, the time between the image forming process request and the image forming process is shortened.

The image forming apparatus according to an eighth aspect of the present invention, in any one of the above-described first to seventh aspects, maybe configured such that in a case that a plurality of image formation operations are performed on an identical sheet of paper, the setting unit is configured to set, before each of the plurality of image formation operations, the image formation condition based on the type of the sheet of paper determined by the type determination unit and the moisture content of the sheet of paper calculated by the moisture content calculation unit.

According to the above configuration, in cases where image forming processes are performed a plurality of times on the identical sheet of paper, the image quality of images formed each time is made uniform.

The image forming apparatus according to a ninth aspect of the present invention, in the above-described first aspect, may include a paper feed cassette configured to contain the sheet of paper; a take-out roller configured to take out the sheet of paper from the paper feed cassette; and a holding roller configured to temporarily hold the sheet of paper on a conveyance path before a transfer process is performed on the sheet of paper. The measuring unit includes a first measuring unit and a second measuring unit, and the first measuring unit is configured to perform a measurement on sheet of paper taken out from the paper feed cassette by the take-out roller and temporarily held by the take-out roller, the second measuring unit is configured to perform measurement on sheet of paper held by the holding roller. In a case that a plurality of image formation operations are performed on an identical sheet of paper, the setting unit is configured to: determine the type of the sheet of paper and calculate the moisture content, based on the intensity of the light measured by the first measuring unit, in a first image formation operation of the plurality of image formation operations, and determine the type of the sheet of paper, based on the intensity of the light measured by the first measuring unit and calculate the moisture content of the sheet of paper, based on the intensity of the light measured by the second measuring unit, in a second image formation operation of the plurality of image formation operations.

According to the above configuration, the image forming condition in the first image formation is set only by a measurement result of the first measuring unit, and thus the image forming conditions is set quickly. As a result, the time between is an image forming process request and the image forming process is shortened.

The image forming apparatus according to a tenth aspect of the present invention, in the above-described second aspect, may be configured to include a reflective plate (standard reflective plate 6) for reflecting light. The reflected-light measuring unit is configured to receive the light reflected by the reflective plate and to measure the intensity of the received light, and the moisture content calculation unit is configured to calculate the moisture content of the sheet of paper based on the intensity of the light reflected by the sheet of paper and the intensity of the light reflected by the reflective plate.

According to the above configuration, it is possible to eliminate the influence of errors such as a fluctuation in amount of light emitted from the reflected-light measuring unit, the sensitivity of the reflected-light measuring unit, or the amplification factor of the amplification circuit that amplifies the output from the reflected-light measuring unit, and thus the moisture content calculation unit calculates the moisture content of the sheet of paper with high accuracy.

The image forming apparatus according to an eleventh aspect of the present invention, in the above-described third aspect, may be configured such that the transmitted-light measuring unit is further configured to measure another intensity of the light emitted from the at least one light source and received without passing through the sheet of paper, and the type determination unit is configured to determine the type of the sheet of paper, based on the intensity of the light transmitted through the sheet of paper measured by the transmitted-light measuring unit and the another intensity of the light received without passing through the sheet of paper.

According to the above configuration, it is possible to eliminate the influence of errors such as a fluctuation in amount of light emitted from the transmitted-light measuring unit, the sensitivity of the transmitted-light measuring unit, or the amplification factor of the amplification circuit that amplifies the output from the transmitted-light measuring unit, and thus the type determination unit determines the type of the sheet of paper with high accuracy.

The image forming apparatus according to a twelfth aspect of the present invention, in any one of the above-described first to eleventh aspects, may be configured such that the measuring unit is configured to irradiate at least two light beams having mutually different wavelengths.

According to the above configuration, as the type determination unit or the moisture content calculation unit determines the type of sheet of paper or calculates the moisture content of the sheet of paper according to the light intensity measured by light of differing wavelengths, respectively, the type of the sheet of paper is determined with high accuracy or the moisture content of the sheet of paper is calculated with high accuracy.

The image forming apparatus according to a thirteenth aspect of the present invention, in any one of the above-described first to twelfth aspects, may be configured such that a wavelength of light emitted by the light source is greater than or equal to 800 nm and less than or equal to 1100 nm.

According to the above configuration, inexpensive infrared LEDs can be used as the light sources, and inexpensive silicon photodiodes can be used as the light-receiving element of the measuring unit.

The image forming apparatus according to a fourteenth aspect of the present invention, in any one of the above-described first to thirteenth aspects, may be configured such that the measuring unit is configured to measure the intensity of light at least two locations of the sheet of paper including a central portion and an end portion.

According to the above configuration, it is possible to mitigate the impact of the characteristics of the sheet of paper at the center portion and the end portion of the sheet of paper P.

The image forming apparatus according to a fifteenth aspect of the present invention, in any one of the above-described first to fourteenth aspects, may include an image carrier (photosensitive drum 11) configured to carry a visible image (toner image) obtained by developing, using a development agent (toner agent), an electrostatic latent image based on image data; a transfer unit (transfer device 15) configured to perform a transfer process of transferring the visible image carried on the image carrier onto a sheet of paper; a fixing unit (16) configured to fix the development agent transferred by the transfer unit to the sheet of paper. The image forming condition includes at least one setting value selected from the group consisting of: a voltage value supplied to the transfer unit, a current value applied to the transfer unit, a pressure applied to the sheet of paper in the fixing unit, a temperature at which the sheet of paper is heated in the fixing unit, and the speed at which the sheet of paper is conveyed in the fixing unit.

The image forming apparatus according to a sixteenth aspect of the present invention, in any one of the above-described first to fifteenth aspects, may be configured such that the image forming condition is set for each of a predetermined range of the type of the sheet of paper and the moisture content of the sheet of paper.

According to the above configuration, suitable image forming conditions is set.

An image forming method according to a seventeenth aspect of the present invention include: irradiating light emitted by at least one light source onto a sheet of paper; receiving light transmitted through the sheet of paper or reflected by the sheet of paper; measuring an intensity of the received light; determining a type of the sheet of paper, based on the intensity of the light measured in the measuring; calculating a moisture content of the sheet of paper, based on the type of the sheet of paper determined in the determining and the intensity of the light measured in the measuring; and setting an image forming condition for the sheet of paper based on the type of the sheet of paper determined in the determining and the moisture content of the sheet of paper calculated in the calculating.

According to the above configuration, effects similar to those in the first aspect are achieved.

The present invention is not limited to each of the above-described embodiments. Various modifications within the scope of the claims are available. An embodiment obtained by appropriately combining technical elements each disclosed in different embodiments falls also within the technical scope of the present invention. Further, by combining technical elements disclosed in the respective embodiments, another technical feature is achievable.

This application claims the benefit of Japanese Patent Application No. 2017-040787 filed Mar. 3, 2017 in the Japan Patent Office, and the entire disclosure of Japanese Patent Application No. 2017-040787 is incorporated herein by reference.

The invention claimed is:

1. An image forming apparatus comprising:

a measuring unit configured to include at least one light source, to irradiate a sheet of paper with light emitted by the at least one light source, to receive the light transmitted through the sheet of paper or reflected by the sheet of paper, and to measure an intensity of the light that has been received;

a type determination unit configured to determine a type of the sheet of paper, based on the intensity of the light measured by the measuring unit;

a moisture content calculation unit configured to calculate a moisture content of the sheet of paper, based on the type of the sheet of paper determined by the type determination unit and the intensity of the light measured by the measuring unit; and a setting unit configured to set an image forming condition for the sheet of paper, based on the type of the sheet of paper determined by the type determination unit and the moisture content of the sheet of paper calculated by the moisture content calculation unit, the moisture content calculation unit being configured to calculate the moisture content by using a moisture content calculation model that has been calculated through a multivariate analysis.

2. The image forming apparatus according to claim 1, wherein the measuring unit includes a reflected-light measuring unit configured to receive the light reflected by the sheet of paper and to measure the intensity of the light that has been received, and the moisture content calculation unit is configured to calculate the moisture content of the sheet of paper, based on the intensity of the light measured by the reflected-light measuring unit.

3. The image forming apparatus according to claim 2, further comprising a reflective plate configured to reflect the light, wherein the reflected-light measuring unit is configured to receive the light reflected by the reflective plate and to measure the intensity of the light that has been received, and the moisture content calculation unit is configured to calculate the moisture content of the sheet of paper, based on the intensity of the light reflected by the sheet of paper and the intensity of the light reflected by the reflective plate.

4. The image forming apparatus according to claim 1, wherein the measuring unit includes a transmitted-light measuring unit configured to receive the light transmitted through the sheet of paper and to measure the intensity of the light that has been received; and the type determination unit is configured to determine the type of the sheet of paper, based on the intensity of the light measured by the transmitted-light unit.

5. The image forming apparatus according to claim 4, wherein the transmitted-light measuring unit is further configured to measure another intensity of the light emitted from the at least one light source and received without passing through the sheet of paper, and the type determination unit is configured to determine the type of the sheet of paper, based on the intensity of the light transmitted through the sheet of paper measured by the transmitted-light measuring unit and the another intensity of the light received without passing through the sheet of paper.

6. The image forming apparatus according to claim 1, further comprising:

a paper feed cassette configured to contain the sheet of paper;

a take-out roller configured to take out the sheet of paper from the paper feed cassette; and a holding roller configured to temporarily hold the sheet of paper on a conveyance path before a transfer process is performed on the sheet of paper, wherein the measuring unit includes a first measuring unit and a second measuring unit, the first measuring unit is configured to measure the sheet of paper taken out from the paper feed cassette by the take-out roller and temporarily held by the take-out roller, the second measuring unit is configured to measure the sheet of paper held by the holding roller, the type determination unit is configured to determine the type of the sheet of paper, based on the intensity of the light measured by the first measuring unit, and the moisture content calculation unit is configured to calculate the moisture content of the sheet of paper, based on the intensity of the light measured by the second measuring unit.

7. The image forming apparatus according to claim 6, wherein the first measuring unit is configured to measure the sheet of paper before an image formation request is issued by a user.

8. The image forming apparatus according to claim 7, wherein the first measuring unit is configured to measure the sheet of paper whenever the paper feed cassette is opened or closed.

9. The image forming apparatus according to claim 1, further comprising:

a paper feed cassette configured to contain the sheet of paper; and a holding roller configured to temporarily hold the sheet of paper on a conveyance path before a transfer process is performed on the sheet of paper; wherein the measuring unit includes a first measuring unit and a second measuring unit, the first measuring unit is configured to irradiate the sheet of paper contained in the paper feed cassette with the light, to receive reflected light, and to measure the intensity of the light that has been received, the second measuring unit is configured to measure the sheet of paper held in the holding roller, the type determination unit is configured to determine the type of the sheet of paper, based on the intensity of the light measured by the first measuring unit, and the moisture content calculation unit is configured to calculate the moisture content of the sheet of paper, based on the intensity of the light measured by the second measuring unit.

10. The image forming apparatus according to claim 1, wherein in a case that a plurality of image formation operations are performed on an identical sheet of paper, the setting unit is configured to set the image formation condition, based on the type of the sheet of paper determined by the type determination unit and the moisture content of the sheet of paper calculated by the moisture content calculation unit, before each of the plurality of image formation operations is performed.

11. The image forming apparatus according to claim 1, further comprising:

a paper feed cassette configured to contain the sheet of paper;

a take-out roller configured to take out the sheet of paper from the paper feed cassette; and a holding roller configured to temporarily hold the sheet of paper on a conveyance path before a transfer process is performed on the sheet of paper, wherein the measuring unit includes a first measuring unit and a second measuring unit, the first measuring unit is configured to measure the sheet of paper taken out from the paper feed cassette by the take-out roller and temporarily held by the take-out roller, the second measuring unit is configured to measure the sheet of paper held by the holding roller, and in a case that a plurality of image formation operations are performed on an identical sheet of paper, the setting unit is configured to:

determine the type of the sheet of paper and calculate the moisture content, based on the intensity of the light measured by the first measuring unit, in a first image formation operation of the plurality of image formation operations, and determine the type of the sheet of paper, based on the intensity of the light measured by the first measuring unit and calculate the moisture content of the sheet of paper, based on the intensity of the light measured by the second measuring unit, in a second image formation operation of the plurality of image formation operations.

12. The image forming apparatus according to claim 1, wherein the measuring unit is configured to irradiate at least two light beams having mutually different wavelengths.

13. The image forming apparatus according to claim 1, wherein a wavelength of the light emitted from the at least one light source is greater than or equal to 800 nm and less than or equal to 1100 nm.

14. The image forming apparatus according to claim 1, wherein the measuring unit is configured to measure the intensity of the light on at least two locations of the sheet of paper including a central portion and an end portion.

15. The image forming apparatus according to claim 1, further comprising:

an image carrier configured to carry a visible image obtained by developing, using a development agent, an electrostatic latent image based on image data;

a transfer unit configured to perform a transfer process of transferring the visible image carried on the image carrier onto the sheet of paper;

a fixing unit configured to fix the development agent transferred by the transfer unit to the sheet of paper, and wherein the image forming condition includes at least one setting value selected from the group consisting of: a voltage value supplied to the transfer unit, a current value applied to the transfer unit, a pressure applied to the sheet of paper in the fixing unit, a temperature at which the sheet of paper is heated in the fixing unit, and a speed at which the sheet of paper is conveyed in the fixing unit.

16. The image forming apparatus according to claim 1, wherein the image forming condition is set for each of a predetermined range of the type of the sheet of paper and a predetermined range of the moisture content of the sheet of paper.

17. An image forming method comprising:

(a) irradiating light emitted by at least one light source onto a sheet of paper;

(b) receiving light transmitted through the sheet of paper or reflected by the sheet of paper;

(c) measuring an intensity of the light that has been received;

(d) determining a type of the sheet of paper, based on the intensity of the light measured in the measuring;

(e) calculating a moisture content of the sheet of paper based on the type of the sheet of paper determined in the determining and the intensity of the light measured in the measuring; and (f) setting an image forming condition for the sheet of paper based on the type of the sheet of paper determined in the determining and the moisture content of the sheet of paper calculated in the calculating, step (e) including calculating the moisture content by using a moisture content calculation model that has been calculated through a multivariate analysis.

18. The image forming apparatus according to claim 1, wherein the multivariate analysis is a regression analysis.

* * * * *